US010787354B2

(12) United States Patent
Ranftl

(10) Patent No.: US 10,787,354 B2
(45) Date of Patent: Sep. 29, 2020

(54) TOOL FOR REMOVAL AND CLOSURE OF BOTTLE AND CONTAINER CAPS

(71) Applicant: Robert W. Ranftl, Rolling Hills Estates, CA (US)

(72) Inventor: Robert W. Ranftl, Rolling Hills Estates, CA (US)

( * ) Notice: Subject to any disclaimer, the term of this patent is extended or adjusted under 35 U.S.C. 154(b) by 0 days.

(21) Appl. No.: 15/150,167

(22) Filed: May 9, 2016

(65) Prior Publication Data

US 2017/0320716 A1 Nov. 9, 2017

(51) Int. Cl.
*B67B 7/14* (2006.01)
*B67B 7/18* (2006.01)

(52) U.S. Cl.
CPC ..... *B67B 7/18* (2013.01); *B67B 7/184* (2013.01)

(58) Field of Classification Search
CPC ..... B67B 7/18; B67B 7/186; B67B 7/184; B67B 7/066; B25B 27/0042
USPC ..... 81/9.4, 3.41, 3.42, 3.29, 3.36, 3.31
See application file for complete search history.

(56) References Cited

U.S. PATENT DOCUMENTS 2,985,044 A * 5/1961 Gill ..... B67B 7/18 81/3.4
3,604,290 A * 9/1971 Waite ..... B67B 7/182 81/3.4
4,001,904 A * 1/1977 Gill ..... B67B 7/18 15/229.13
4,337,678 A * 7/1982 Mumford ..... B67B 7/18 81/3.4
4,702,129 A * 10/1987 Allen ..... B67B 7/18 81/3.09
5,000,062 A * 3/1991 Bergmeister ..... B67B 7/066 81/3.4
D365,261 S * 12/1995 Munro ..... D8/40
D401,127 S * 11/1998 Plantz ..... D8/33
D482,251 S * 11/2003 Kelleghan ..... D8/40
7,267,031 B1 * 9/2007 Burton ..... B67B 7/18 81/3.09
8,449,492 B2 * 5/2013 Sargent, Jr. ..... A61F 13/26 424/431

(Continued)

*Primary Examiner* — Joseph J Hail
*Assistant Examiner* — Shantese L McDonald
(74) *Attorney, Agent, or Firm* — Klein, O'Neill & Singh, LLP

(57) ABSTRACT

A tool includes a resilient relatively soft tool body defining a closed top surface and a surrounding side surface extending downwardly therefrom. The tool further includes a bottom surface which defines an upwardly extending generally cylindrical recess therein. The recess includes interior sidewalls which in their preferred form support a plurality of gripping ridges or edges. The recess is sized and shaped to receive a portion of a bottle cap thereby allowing the user to grip the tool and squeeze the tool body to force its recess surfaces against the bottle cap in a gripping engagement and thereafter applying a torque or twist to the tool allowing the bottle cap to be easily removed. In its preferred fabrication, the tool further includes a plurality of radially extending relief slots formed in the recess wall to facilitate better gripping action and to allow the recess wall to stretch and expand thereby accommodating different bottle cap sizes. Finally, the tool may utilize a plurality of differently sized recesses arranged in descending order to engage different bottle cap sizes.

20 Claims, 14 Drawing Sheets

(56) References Cited

U.S. PATENT DOCUMENTS

| | | | | |
|---|---|---|---|---|
| 2008/0011127 | A1* | 1/2008 | Mazur | B67B 7/14<br>81/3.09 |
| 2008/0072709 | A1* | 3/2008 | Dye | B67B 7/16<br>81/3.09 |
| 2008/0176670 | A1* | 7/2008 | Gill | B29C 45/16<br>473/300 |

* cited by examiner

TOOL FOR REMOVAL AND CLOSURE OF BOTTLE AND CONTAINER CAPS

CROSS REFERENCE TO RELATED APPLICATION

This application includes disclosure set forth in a provisional patent application, 61/955,700, filed Mar. 19, 2014 in the name of Robert W. Ranftl and entitled Tool for Removal and Closure of Bottle and Container Caps, the disclosure of which is hereby incorporated herein by reference.

FIELD OF THE INVENTION

This invention relates generally to keychain type tools and novelty items and particularly to tools utilized in manipulating bottle caps, including plastic water bottle caps, to and from bottles, twist-off metal crimped-on bottle caps, medicine container caps or similar container caps, whether metal or plastic.

BACKGROUND OF THE INVENTION

The sale and transport of many liquids or granular materials utilize containers which are generally described as "bottles". Many such bottles are used in transport and sale of potable liquids such as water, soda, milk and other foods and beverages as well as medicines. Such bottles are also used in the sale and transport of liquids and granular materials which are not suitable for consumption but provide liquids such as cleaning agents or chemicals.

While bottles have been provided in a virtually endless variety of shapes, sizes and constructions, perhaps the most common type of bottle in the modern marketplace utilizes a container body defining a reservoir therein and supporting a closed bottom with an upwardly extending filler neck. Such bottles are often made of glass or plastic materials. However, bottles have also been provided which are fabricated from a metal material such as common aluminum or the like. Closure of the typical bottle is provided by a bottle cap which is usually snapped upon the bottle neck or received upon the neck in a twist or threaded engagement.

Of particular interest to the use of the present invention tool are those bottle caps generally described as "twist-off" caps so named because they are removed from and replaced upon the bottle neck in a twisting (rotating) motion upon the bottle neck. While some metal twist-off type bottle caps are crimped upon the bottle neck, most are threaded and secured to cooperating threads on the bottle neck.

One of the difficulties encountered using bottles having twist-off type bottle caps arises due to the tight seal which the bottled product requires to avoid leakage and contamination of the bottle contents. For the most part, seal integrity is achieved by a relatively tight attachment of the cap upon the bottle neck.

While the use of a tight closure of the cap upon the bottle neck often renders the bottle cap difficult to manipulate and remove, additional difficulties are often created through the use of tear-off integrity closure mechanisms integrally formed on the bottle cap. These integrity closures or seals are often configured to fracture and tear apart when the bottle cap is twisted upon the neck during the initial opening of the bottle. Such integrity closures are very effective in reassuring consumers that the bottle cap has not been previously removed and that the bottle contents are undisturbed and uncontaminated. However, the integrity type closure seals further increase the amount of torque required to initially open a bottle.

Thus, despite the advantages of economy, convenience and pervasiveness of bottles utilizing twist type caps, several problems arise for the consumer during typical use. As mentioned above, the need to provide secure closure and a trustworthy leakproof seal leads manufacturers to provide bottle caps that are securely twisted closed and often embellished with an integrity seal closure mechanism. As a result, it simply takes a substantial torque to twist the typical bottle cap from the bottle neck during use.

Additional problems arise in that many bottle caps are relatively small and difficult to manipulate. This problem is particularly frustrating for users such as young children, aged persons and persons having debilitating illnesses such as arthritis or the like. In further addition, problems are exacerbated in that bottle and container caps are not only small in size and therefore present a limited grip area, they tend to be fabricated of materials which are somewhat slippery and therefore even more difficult to grasp with sufficient gripping force to allow twisting of the bottle cap. Another difficulty with grasping a cap by hand arises due to the abrasive surface on the typical cap, which, with repeated contact, may cause irritation or injury.

There arises therefore an unresolved and unsatisfied need in the art for an easy to use, inexpensive and convenient tool for use in opening tight bottle caps.

SUMMARY OF THE INVENTION

Accordingly, it is a general object of the present, invention to provide an improved tool. It is a more particular object of the present invention to provide an improved tool which is easy to use and which is convenient to carry. It is a still more particular object of the present invention to provide an improved tool for removal and closure of bottle and container caps which is easy to use and convenient to carry and which is lightweight, low in cost and which is colorful, amusing, interesting and which accommodates a range of different sized caps.

The present invention tool provides a resilient relatively soft tool body defining a closed top surface and a surrounding side surface extending downwardly therefrom. The present invention tool further includes a bottom surface which defines an upwardly extending generally cylindrical recess therein. The recess includes interior walls which in their preferred form support a plurality of gripping ridges or edges. The recess is sized and shaped to receive a portion of a bottle cap thereby allowing the user to grip the tool squeezing its recess surfaces against the bottle cap in a gripping engagement and thereafter applying a torque or twist to the tool allowing the bottle cap to be easily removed. In its preferred fabrication, the present invention tool further includes a plurality of radially extending relief slots formed in the recess wall to facilitate better gripping action and to allow the recess wall to stretch and expand thereby accommodating different bottle cap sizes. Finally, the present invention tool may utilize a plurality of differently sized recesses arranged in descending order to engage different bottle cap sizes.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
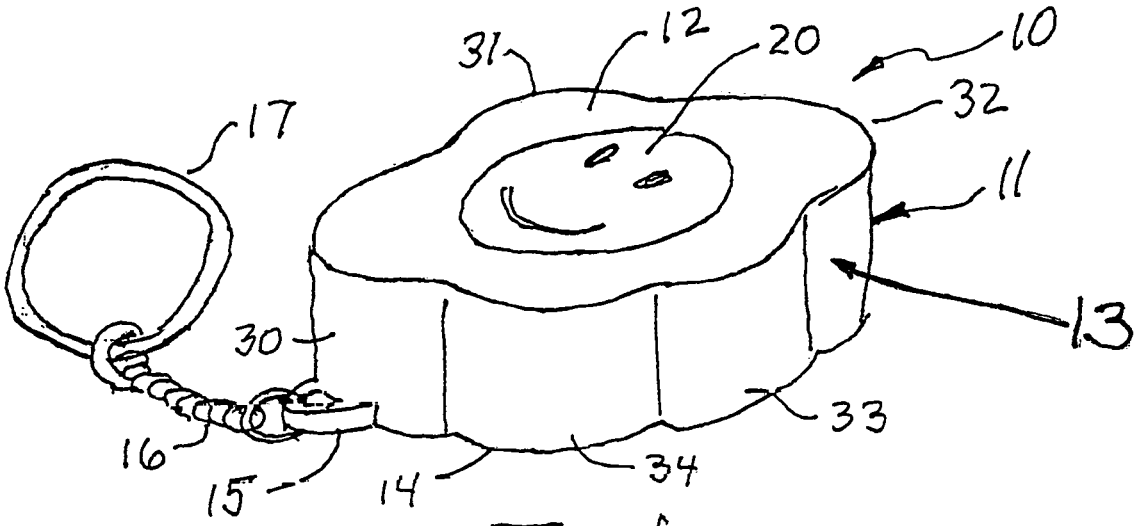
FIG. 1 sets forth a perspective view of a tool constructed in accordance with the present invention.

By way of overview, the present invention tool includes a body formed of a soft deformable resilient material such as silicone foam rubber or foam plastic, silicone rubber, PVC or other elastomers. The tool is fabricated to also serve as a keychain fob or a novelty item. When used as a keychain fob, the tool typically includes an attachment tab which in turn provides attachment to a keychain or the like. The soft resilient deformable body may define an easily gripped ergonomic shape. The soft resilient deformable body may also be formed in a fanciful amusing and entertaining shape such as a flower or other suitable amusement device. Alternatively, the body may define an ergonomic shape. The tool body is formed to define a closed top surface preferably supporting a decorative or amusing icon and having downwardly extending continuous sidewalls surrounding the periphery of the top portion. Alternatively, the top surface may be entirely or partially open to reveal the top surface of an inserted cap. The underside of the tool body includes a generally planar surface within which a bottle cap receiving recess is formed. The interior side wall of the recess supports a plurality of gripping elements such as knurl or parallel gripping ridges. The recess is generally cylindrical and terminates beneath the top portion of the body. In its preferred form, the recess sidewall further defines a plurality of radially extending equally spaced expansion slots which facilitate stretching of the tool body to enhance the gripping of different sized caps. In some embodiments, the body top surface may define a aperture extending through the entire body.

The present invention tool assists the user in removing conventional twist-off caps such as those found upon personal sized water bottles or the like. In addition, the inventive tool may provide an amusement item or key fob. The tool is used by placing the body of the tool upon the bottle cap such that the bottle cap is received within the bottle cap recess. Thereafter, the user simply squeezes the tool deforming the tool body slightly and causing the interior surfaces of the recess to grip the outer surface of the bottle cap. Once the tool has been squeezed to accommodate and conform to the particular bottle cap, the user simply rotates the tool which in turn carries the bottle cap and removes it from the neck of the bottle. In the preferred fabrication of the invention, the soft resilient body is able to stretch and because of the expansion slots accommodate different bottle cap sizes. In alternate environments, the tool body defines multiple bottle cap resources arranged in descending size to further accommodate different standard sized bottle caps. In still further alternate embodiments, the bottle cap recess defines a frustoconical interior wall which provides a tapered wall in order to accommodate a variety of bottle cap sizes. To increase the amusement, entertainment and licensing aspects of the tool, a variety of different shapes and configurations of the tool body are provided together with a corresponding variety of icons or other amusement appearance enhancements upon the top surface of the tool body.

More specifically, FIG. 1 sets forth a perspective view of a tool constructed in accordance with the present invention and generally referenced by numeral 10. Tool 10 includes a resilient soft deformable body 11 fabricated of a material such as silicone, foam rubber or foam plastic, silicone rubber, PVC or other elastomers. In the preferred embodiment of the invention material hardness of body 11 between 20 Shore A to 70 Shore A is utilized with an optimum hardness of 35 Shore A being suitable for most applications. The essential aspects of body 11 include sufficient softness and deformity to readily accommodate the squeezing action of the user while concurrently exhibiting sufficient resilience to restore its original shape when released and used as a decorative key fob. The resilient deformable character of the deformable body allows the tool to stretch and accommodate differently sized and contoured caps. It will also be apparent to those skilled in the art that the size and dimension of the cap receiving recess may be selected to suit particular requirements of use. It has been found to be advantageous to utilize a preferred fit in which the bottle cap recess is slightly smaller that the bottle cap in order to introduce a slight stretch (referred to as "preload") of the tool to aid the user's grip of the bottle cap. In the embodiment shown in FIGS. 1 through 5, body 11 is fashioned in a fanciful flower-like shape for easy gripping and for amusement and entertainment value. In the preferred fabrication of the invention, the outer surface of body 11 is given a matte finish to enhance the user's grip on the tool. Conversely, the interior surface of cap recess 21 is provided with a shiny surface to provide a "sticky" characteristic to enhance the tool's grip upon a bottle cap. It will be apparent to those skilled in the art that the flower-like shape of body 11 shown in FIGS. 1 through 5 is merely illustrative and that a virtually endless variety of body shapes may be utilized without departing from the spirit and scope of the present invention. Body 11 defines a top surface 12 and a surrounding downwardly extending sidewall 13. As mentioned, sidewall 13 is fluted to suggest the petals of a flower or the like which also aids the user in gripping the tool. In addition, body 11 further supports an amusing icon 20 which in the example of FIGS. 1 through 5 comprises a well known "happy face". Once again it will be understood that virtually any style or type of amusement icon may be supported upon top surface 12 without departing from the spirit and scope of the present invention. Sidewall 13 further supports an outwardly extending keychain tab 15 which is attached to a length of keychain 16 having its remaining end coupled to a conventional key ring. Thus, body 11 defines equally spaced circular shaped radially extending petals 30 through 34. However, it will be understood that different numbers of petals may be utilized without departing from the spirit and scope of the present invention.

Figure 2:
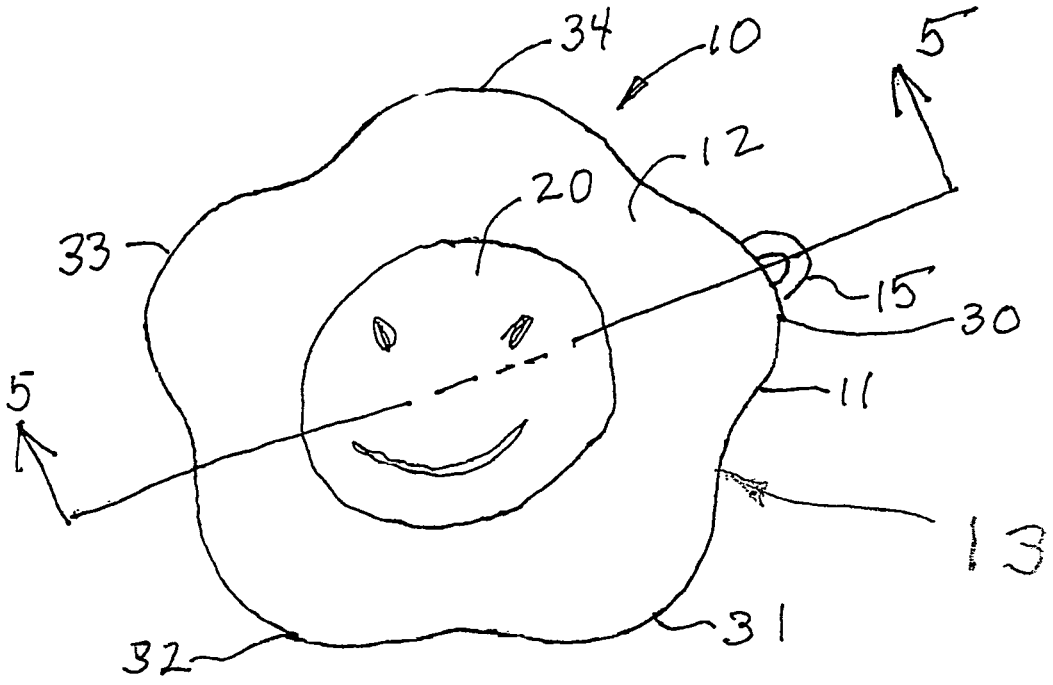
FIG. 2 sets forth a top view of the present invention tool shown in FIG. 1.

FIG. 2 sets forth a top view of tool 10 showing body 11 having top 12 which in turn supports amusement icon 20. Body 11 is also shown having a plurality of circular shaped radially extending equally spaced petals 30 through 34. A key chain tab 15 extends from body 11 at petal 30.

Figure 3:
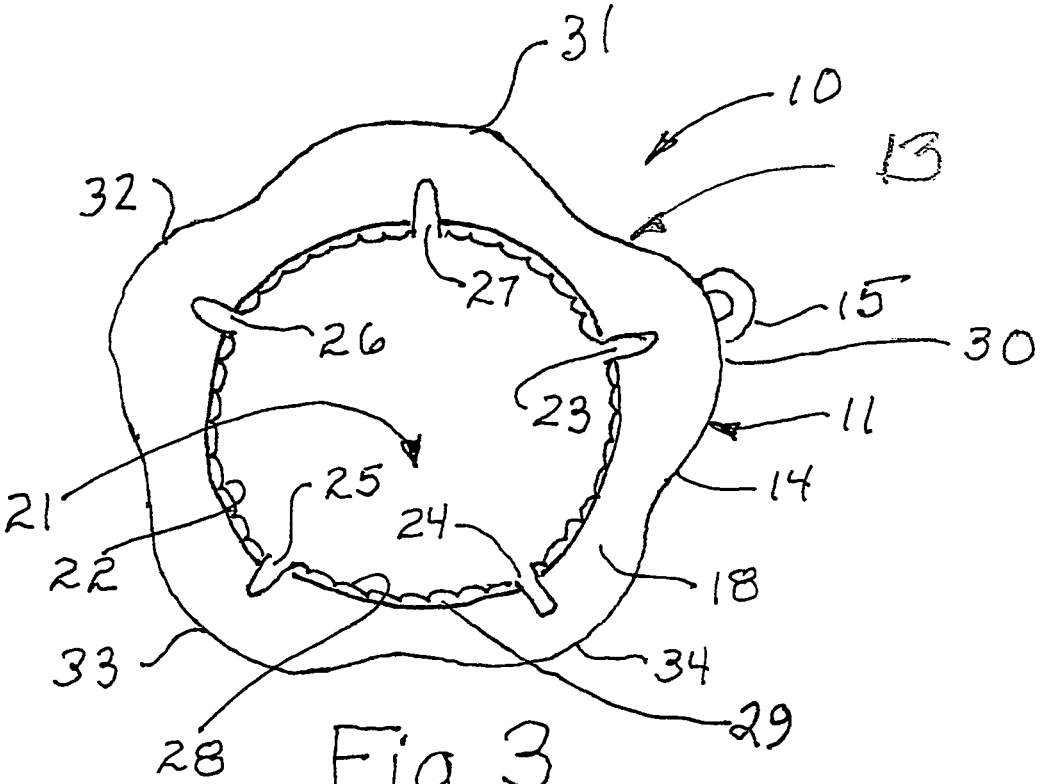
FIG. 3 sets forth a bottom view of the present invention tool shown in FIG. 1.

FIG. 3 sets forth a bottom view of tool 10. As described above, tool 10 includes a body 11 having a plurality of radially extending equally spaced circular shaped petals 30 through 34 formed in sidewall 13. Sidewall 13 terminates in a bottom edge 14. Body 11 further includes a bottom surface 18 which defines a bottle cap recess 21. Bottle cap recess 21 is generally cylindrical in shape having a recess wall 22. Recess wall 22 defines a plurality of radially extending expansion slots 23 through 26. To maintain the maximum wall strength for recess wall 22, it is preferable that expansion slots 23 through 27 be generally centered in alignment with petals 30 through 34 as shown in FIG. 3. Additionally, in its preferred embodiment, recess wall 22 defines some type of gripping elements to better engage a bottle cap. In the example shown in FIG. 3, a plurality of parallel equally sized gripping ridges 28 are shown formed in recess wall 22. In order to facilitate the insertion of a bottle cap, or the like, into cap recess 21, sidewall 22 defines a chamfer 29 between expansion slots 23 through 27.

Figure 4:
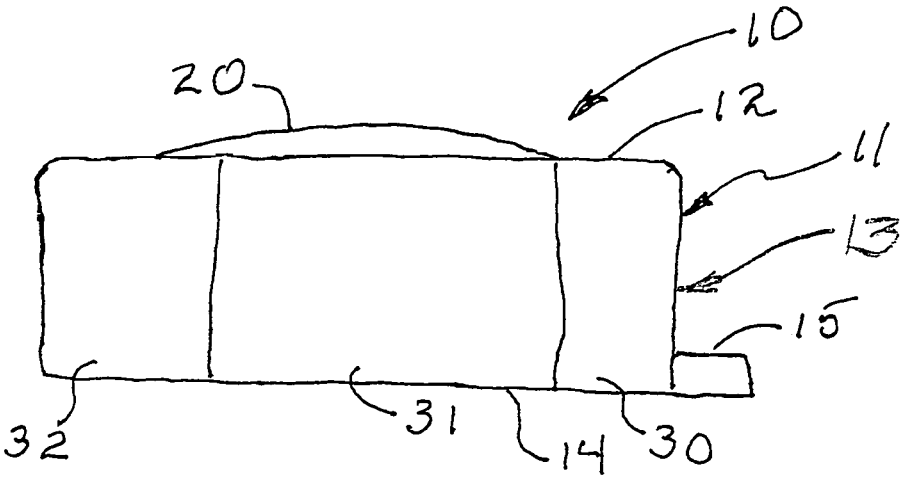
FIG. 4 sets forth a side view of the present invention tool shown in FIG. 1, the remaining side view thereof being a mirror image thereof.

FIG. 4 sets forth a right side elevation view of tool 10. It will be apparent to those skilled in the art that the left side view of tool 10 is a mirror image of the right side view shown in FIG. 4. More specifically, tool 10 includes a body 11 which, as described above, is preferably formed of a resilient soft deformable material such as silicone, foam rubber or plastic. Body 11 further defines a sidewall 13 extending downwardly from a top 12. Top 12 further supports an amusement icon 20. As is also described above, sidewall 13 is formed into a plurality of petals including petals 30, 31 and 32 seen in FIG. 4. Sidewall 13 also defines a bottom edge 14 and an outwardly extending keychain tab 15.

Figure 5:
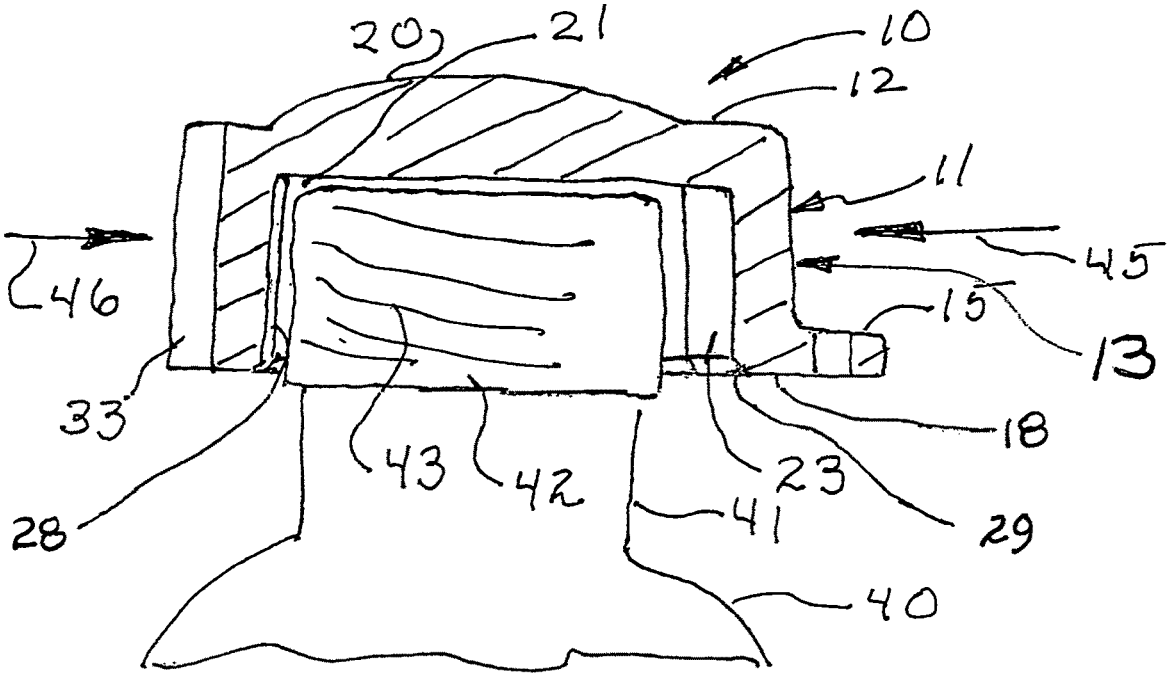
FIG. 5 sets forth a section view of the present invention tool taken along section lines 5-5 in FIG. 2 illustrating the application of the present invention tool to an illustrative bottle cap.

FIG. 5 sets forth a section view of tool 10 taken along section lines 5-5 in FIG. 2. FIG. 5 also shows an illustrative bottle neck and bottle cap received within tool 10 for purposes of illustrating the operation and use of the present invention tool.

More specifically and as is described above, tool 10 includes a body 11 formed of a resilient deformable soft material having a top 12 supporting an amusement icon 20. Top 12 may be domed as shown in FIG. 4 or alternatively, may be substantially flat, as desired. Body 11 further defines a downwardly extending surrounding sidewall 13 fabricated to provide a plurality of petals such as petals 30 and 32 seen in FIG. 5. Sidewall 13 terminates in a bottom surface 18. Bottom surface 18 further defines a generally cylindrical bottle cap recess 21. Recess 21 is described above and includes a plurality of expansion slots such as slot 23 together with a plurality of gripping ridges such as ridges 28.

For purposes of illustration, a conventional bottle 40 having an upwardly extending generally cylindrical neck 41 is also shown in FIG. 5. In accordance with conventional bottling techniques, neck 41 of bottle 40 is closed and sealed by a bottle cap 42. In accordance with conventional bottling techniques, bottle neck 41 and cap 42 define cooperating threads 43 which provide the twist sealing and twist opening action of bottle 40. In accordance with the present invention, tool 10 is shown positioned upon bottle cap 42 by inserting bottle cap 42 upwardly into bottle cap recess 21. It will be apparent to those skilled in the art that in the anticipated use of the present invention tool, a range of bottle cap sizes may be accommodated by the present invention tool. Thus, in the illustration shown in FIG. 5, bottle cap 42 fits generally within recess 21 within body 11 such that the above mentioned slight stretch of cap recess 21 (often referred to as a "preload") results. It will be recalled that the preferred fit of bottle cap 42 within cap recess 21 is selected to cause cap 42 to slightly stretch cap recess 21 and thereby aid the user's grip. It will be apparent to those skilled in the art however that the present invention tool may accommodate a somewhat smaller bottle cap by simply being squeezed upon the bottle cap or, conversely, may accommodate a somewhat larger bottle cap 42 as the resilient material or body 11 and the cooperation of expansion slots formed therein allow tool 10 to be "stretched upon" bottle cap 42. In any event once tool 10 is situation upon bottle cap 42, the user simply grasps tool 10 and squeezes inwardly as indicated by arrows 45 and 46. The inward forces upon body 11 deform body 11 to cap 42 and create sufficient grip (friction) to allow torque applied to body 11 to be effectively transmitted to cap 42 which in turn twists cap 42 from neck 41. In accordance with an important aspect of the present invention, a chamfer 28 is formed at the intersection of cap recess 21 and bottom surface 18. The use of chamfer 28 is preferred because it aids the user in fitting tool 10 upon a bottle cap.

Figure 6:
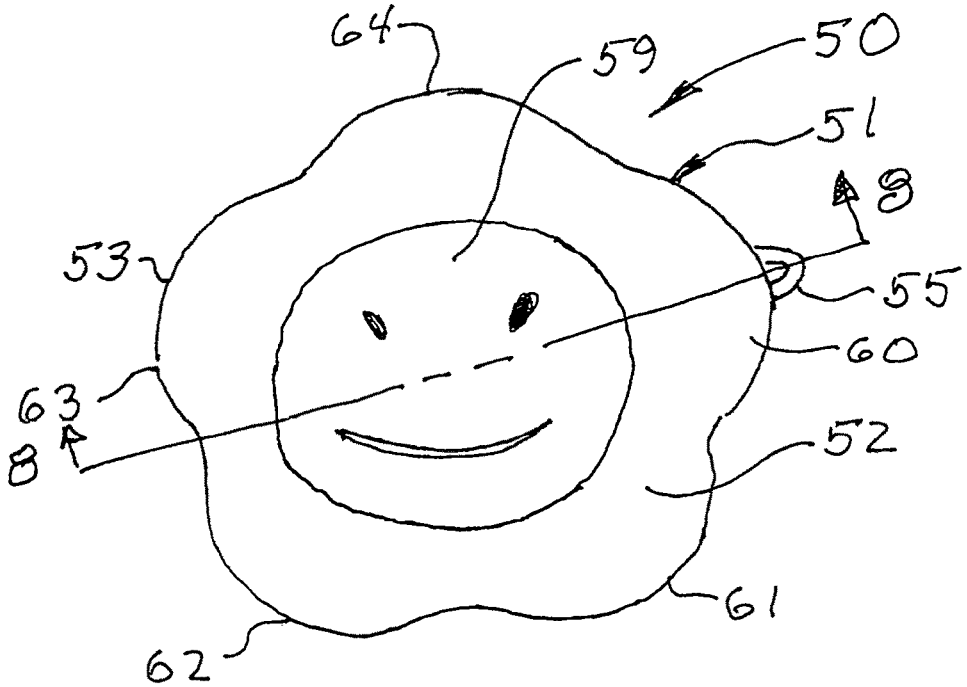
FIG. 6 sets forth a top view of an alternate embodiment of the present invention tool.

FIG. 6 sets forth a top view of an alternate embodiment of the present invention tool generally referenced by numeral 50. With temporary reference to FIGS. 6 through 8, it will be apparent to those skilled in the art that tool 50 is substantially the same as tool 10 set forth above with the difference being found in a double bottle cap recess fabrication shown clearly in FIGS. 7 and 8.

Figure 7:
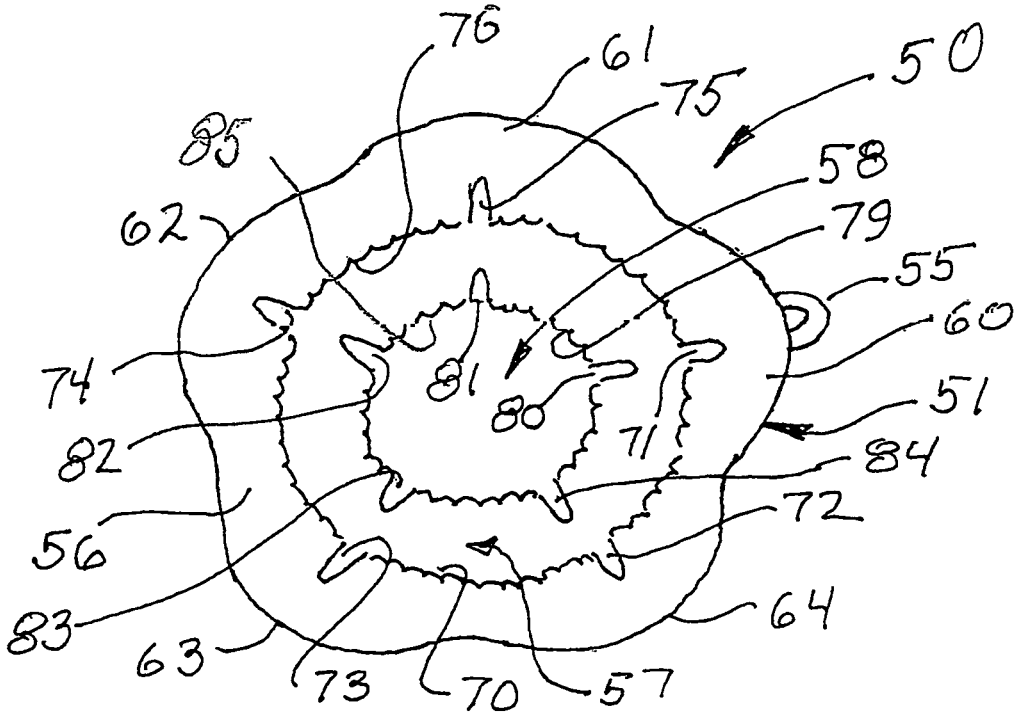
FIG. 7 sets forth a bottom view of the alternate embodiment of the present invention tool shown in FIG. 6.

FIG. 7, sets forth a bottom view of tool 50 which includes a resilient soft deformable body 51 formed to define a plurality of radially extending petals 60 through 64 together with a keychain tab 55. In similar manner to the fabrication of tool 10 described above, body 51 includes a sidewall 53 forming petals 60 through 64 which in turn supports keychain tab 55. Body 51 further includes a bottom surface 56 within which a pair of concentric generally cylindrical bottle cap recesses 57 and 58 are formed. Bottle cap recess 57 is substantially identical to bottle cap recess 21 shown above in FIGS. 1 through 5 and thus defines a generally cylindrical recess wall 70 having a plurality of radially extending expansion slots 71 through 75 formed therein. Recess wall 70 further includes a plurality of gripping elements 76. Recess 58 is substantially identical to recess 57 but formed of a substantially smaller diameter. Thus, recess 58 is generally cylindrical having a recess wall 79 which is spaced inwardly from recess wall of recess 57. In further correspondence to the general shape of recess 57, smaller recess 58 defines a plurality of radially extending expansion slots 80 through 84 together with a plurality of gripping elements 85. As is illustrated below in FIG. 8, recesses 57 and 58 allow tool 50 to accommodate two different sizes of bottle caps. As is described above, it will also be understood that both recesses 57 and 58 utilize the resilient character of body 51 together with their respective expansion slots to accommodate a variation of bottle cap sizes. Thus, tool 50 will be understood to accommodate a pair of bottle cap size ranges rather than simply accommodating two different bottle cap sizes.

Figure 8:
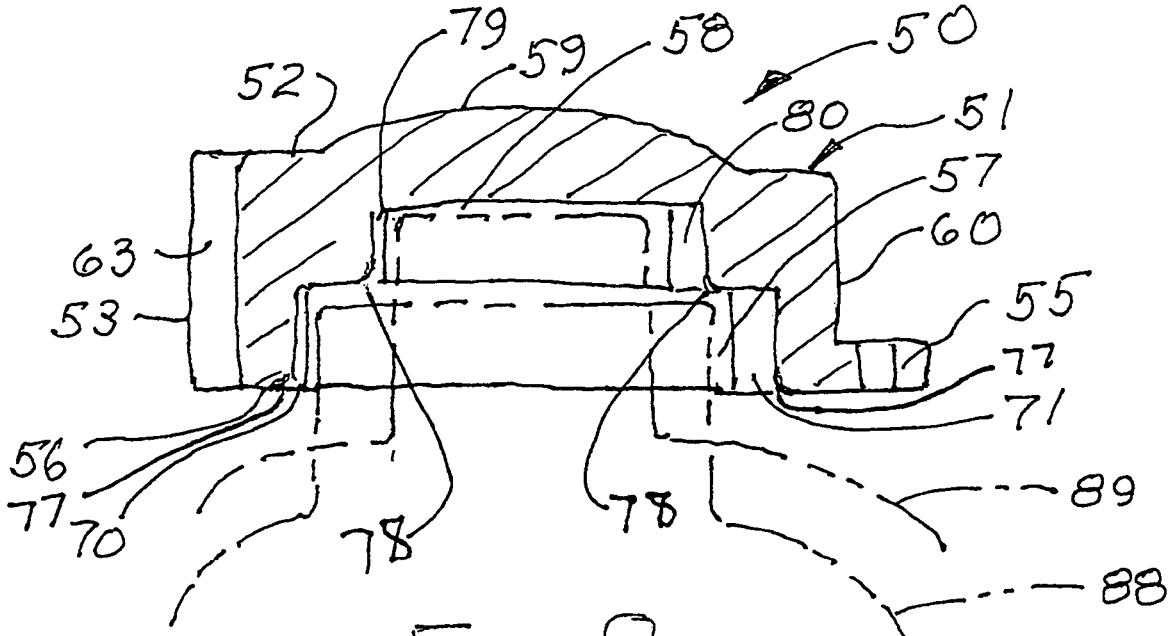
FIG. 8 sets forth a section view of the alternate embodiment of the present invention tool shown in FIG. 6 taken along section lines 8-8 therein.

FIG. 8 sets forth a section view of tool 50 taken along section lines 8-8 in FIG. 6. As described above, tool 50 includes a resilient deformable body 51 having a top 52 supporting an icon 59. Body 51 further includes a sidewall 53 which defines a plurality of circular petals such as petals 60 and 63 shown in FIG. 8. Body 51 further defines a bottom surface 56 which in turn defines a pair of generally cylindrical concentrically aligned bottle cap recesses 57 and 58. Bottle cap recesses 57 and 58 are substantially identical in shape with the exception that bottle cap recess 58 is substantially smaller in diameter than bottle cap recess 57. Thus, recess 57 includes a plurality of expansion slots such as expansion slot 71 while bottle cap recess 58 includes a similar plurality of expansion slots such as slot 80. In addition, bottle cap recesses 57 and 58 also define edges 77 and 78 respectively which are either chamfered or radiused to facilitate insertion of a cap into the recess. FIG. 8 also shown phantom-line depictions of bottles 88 and 89. Bottle 88 illustrates a larger diameter bottle neck and cap which is received within recess 57. Bottle 89 shows a smaller diameter bottle neck and cap which fits within recess 58. It will be noted that recesses 57 and 58 are thus able to accommodate different sizes of bottle caps.

Figure 9:
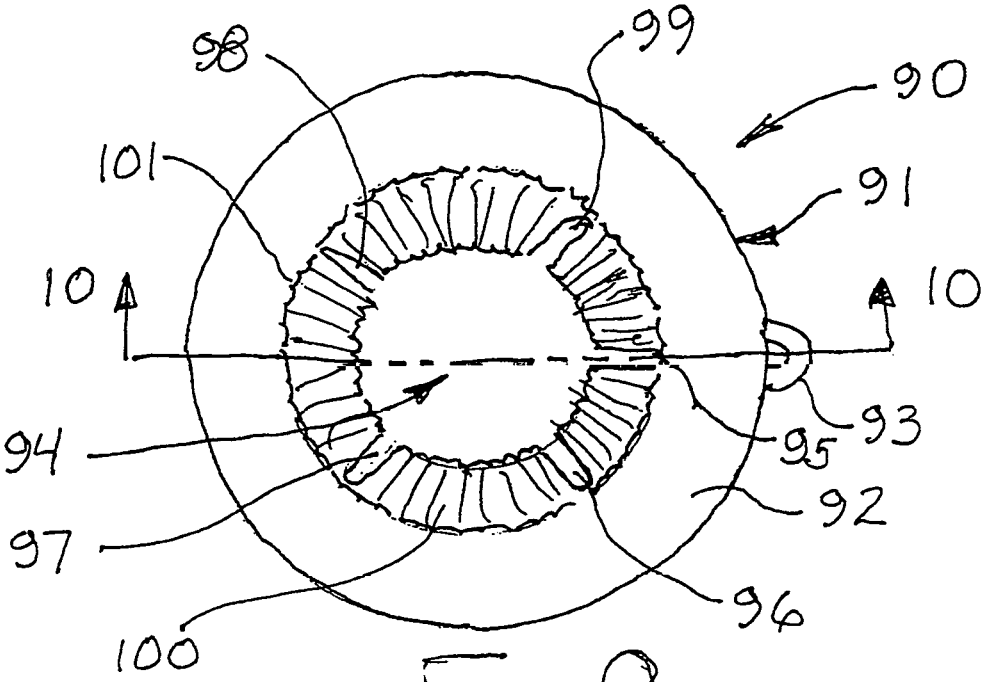
FIG. 9 sets forth a bottom view of a still further alternate embodiment of the present invention tool.
Figure 13:
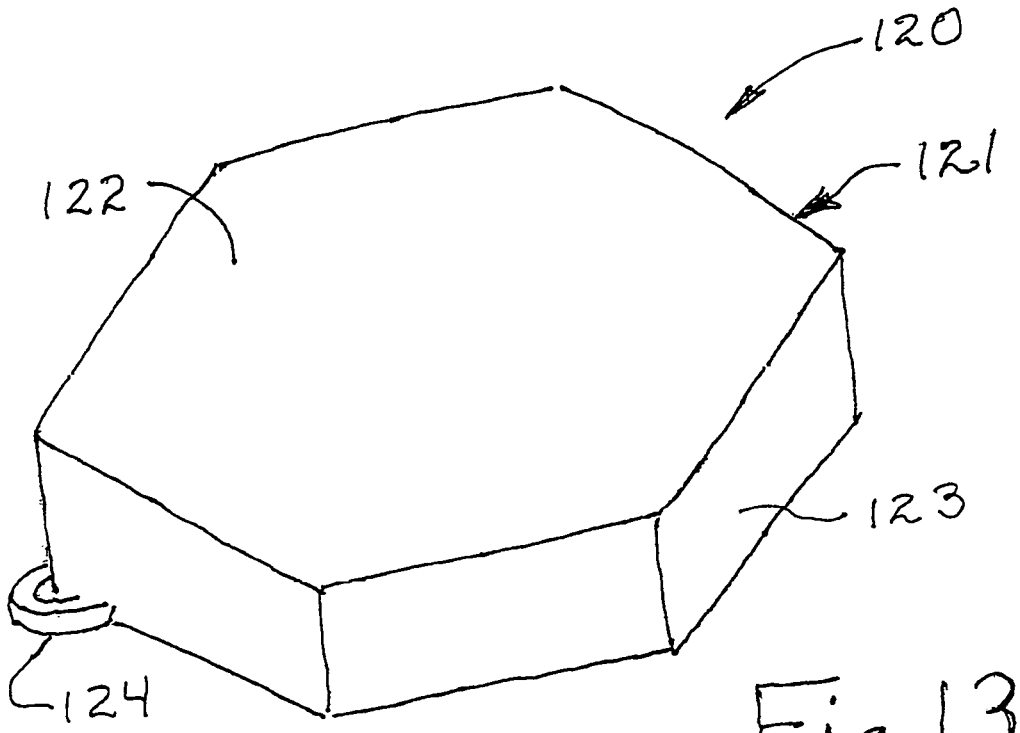
FIG. 13 sets forth a perspective view of a still further alternate embodiment of the present invention tool.

FIG. 9 sets forth a bottom view of a further alternate embodiment of the present invention tool generally referenced by numeral 90. Tool 90 includes a body 91 preferably formed of a soft resilient deformable material. The general shape of body 91 may correspond to body 51 shown above in FIG. 6 or, alternatively, may be shaped in any one of a variety of shapes. For example, FIGS. 11 and 13 shown and described below illustrate alternative shapes for body 91. In accordance with an important aspect of the present invention, tool 90 shows an alternate configuration for the bottle cap recess. Thus, body 91 defines a frusto-conical bottle cap recess 94. Recess 94 defines a tapered bottle cap recess wall 101 which in turn supports a plurality of gripping ridges 100. Wall 101 further defines a plurality of equally spaced radially extending expansion slots 95 through 99 formed therein. In accordance with the embodiment of the invention shown in FIGS. 9 and 10, the tapered sidewall structure of recess 94 facilitates the application of tool 90 to a substantial variety of differently sized bottle caps.

Figure 10:
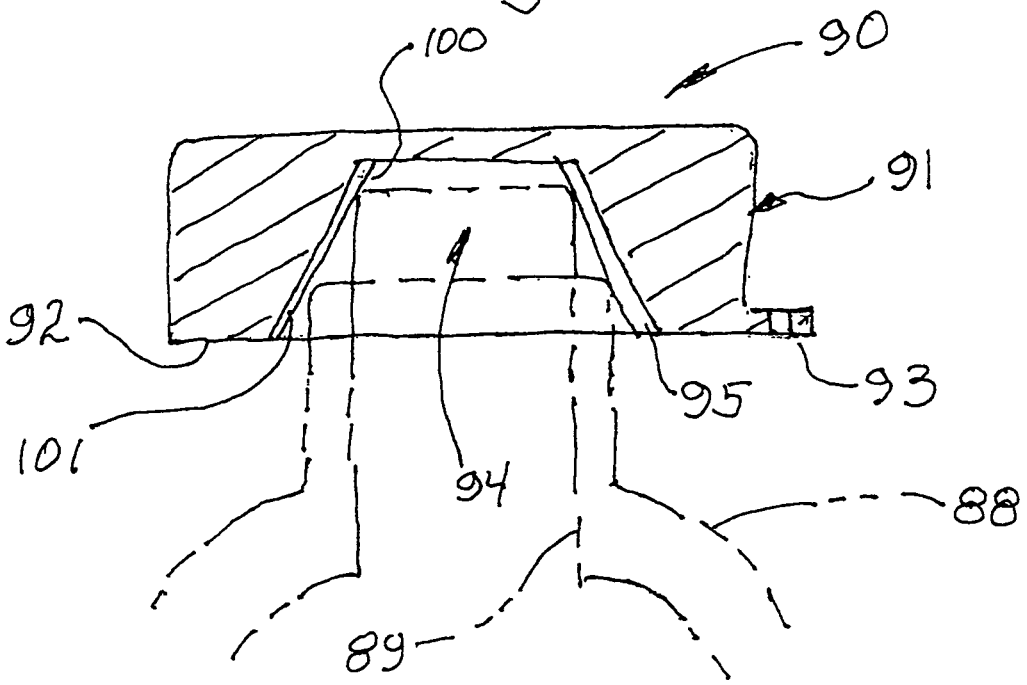
FIG. 10 sets forth a section view of the embodiment of the present invention present invention tool shown in FIG. 9 taken along section lines 10-10 therein.
Figure 11:
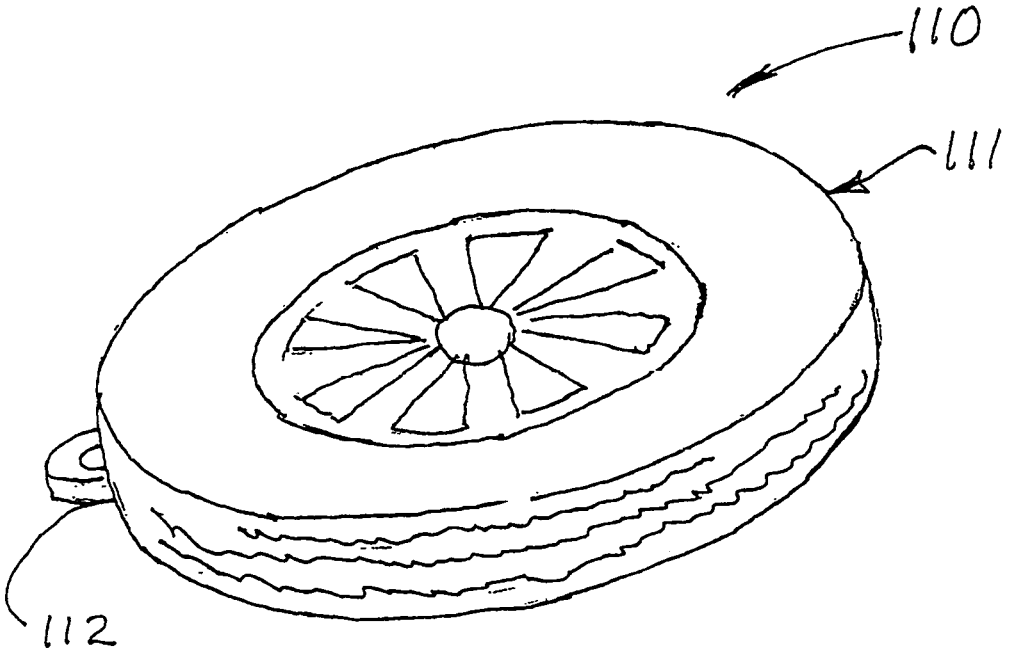
FIG. 11 sets forth a perspective view of a still further alternate embodiment of the present invention tool.

FIG. 10 sets forth a section view of tool 90 taken along section lines 10-10 in FIG. 9. As described above, tool 90 includes a soft resilient deformable body 91 having a frusto-conical bottle cap recess 94 formed therein. Body 91 further supports a keychain tab 93 and further defines a bottom surface 92. Frusto-conical bottle cap recess 94 includes a tapered wall 101 within which a plurality of expansion slots such as expansion slot 95 are formed. Tapered wall 101 further includes a plurality of gripping elements 100 formed therein.

For purposes of illustration, a pair of differently sized bottles 88 and 89 are shown in phantom-line depiction having their respective cap portions extending into recess 94. As will be apparent to those skilled in the art, the tapered construction of recess wall 101 allows recess 94 to accommodate different sizes of bottle caps.

FIG. 11 sets forth a perspective view of a still further alternate embodiment of the present invention tool generally referenced by numeral 110. Tool 110 includes a soft deformable resilient body 111 fabricated of a soft deformable material having a textured outer surface that enhances friction and gripping action and a shinny inside surface that improves tool grip. Body 111 is formed to generally resemble a vehicle tire and wheel. Thus, tool 110 is illustrative of a further variation of the appearance of the present invention tool to further increase the amusement, entertainment and licensing value thereof. To facilitate functioning as a keychain fob, body 111 also includes a keychain tab 112.

Figure 12:
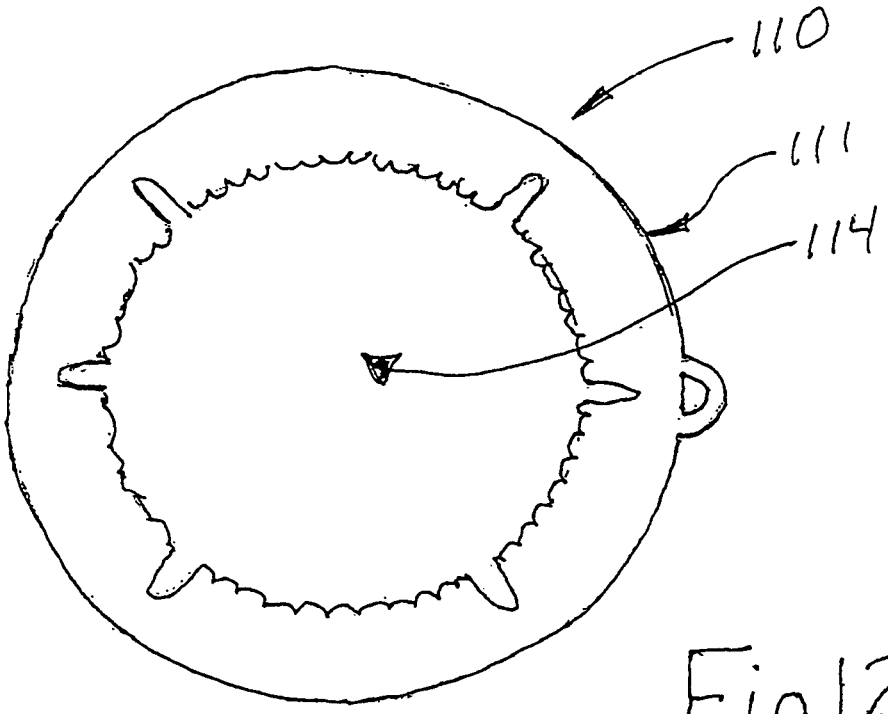
FIG. 12 sets forth a bottom view of the alternate embodiment of the present invention tool shown in FIG. 11.

FIG. 12 set forth a bottom view of tool 110 showing bottom surface 113 defining a cap recess 114. In accordance with the present invention, bottle cap recess 114 may utilize the single recess fabrication such as recess 21 shown in FIG.

3, the double cap recess shown in FIG. 7 or the frusto-conical cap recess shown in tool 110 without departing from the spirit and scope of the present invention. For purposes of illustration, however, FIG. 12 shows cap recess 114 conforming generally to cap recess 21 shown in FIG. 3.

FIG. 13 sets forth a perspective view of a still further alternate embodiment of the present invention tool generally referenced by numeral 120. Tool 120 includes a soft deformable resilient body 121. Body 121 is shaped to generally resemble the hexagonal head of a conventional machine or automotive bolt. Accordingly, body 121 defines a plurality of hexagonal facets 123 and a top surface 122. Body 121 further includes a keychain tab 124.

Figure 14:
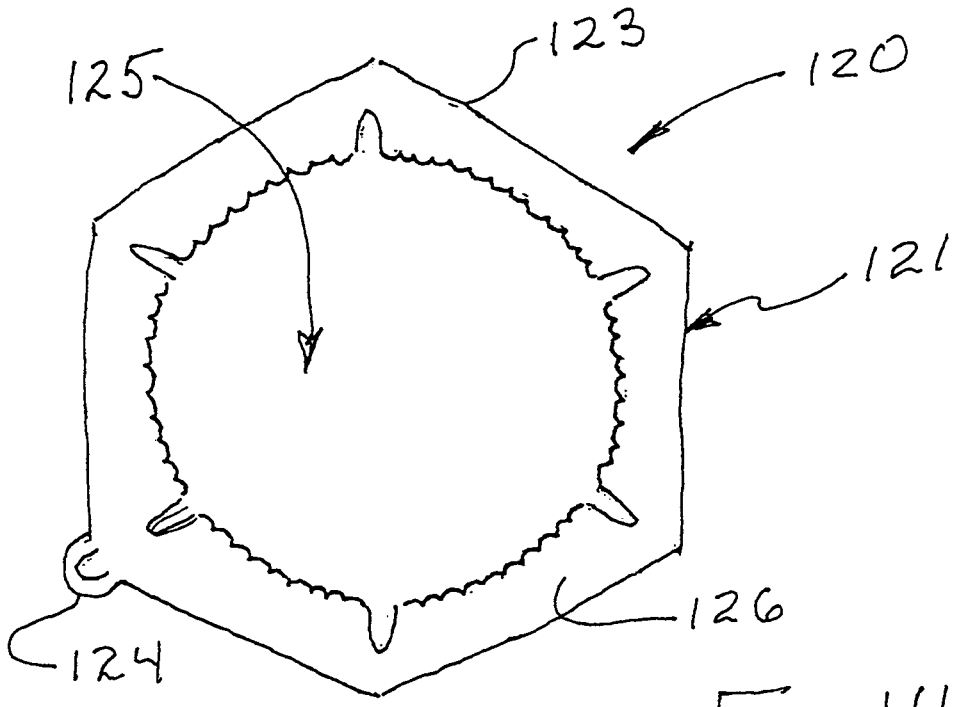
FIG. 14 sets forth a bottom view of the alternate embodiment of the present invention tool shown in FIG. 13.

FIG. 14 sets forth a bottom view of tool 120. As described above, tool 120 includes a body 121 formed in a generally hexagonal shape defining a plurality of hexagonal facets 123. Body 121 further defines a bottom surface 126 which in turn defines a cap recess 125. Body 121 further includes a keychain tab 124.

Figure 15:
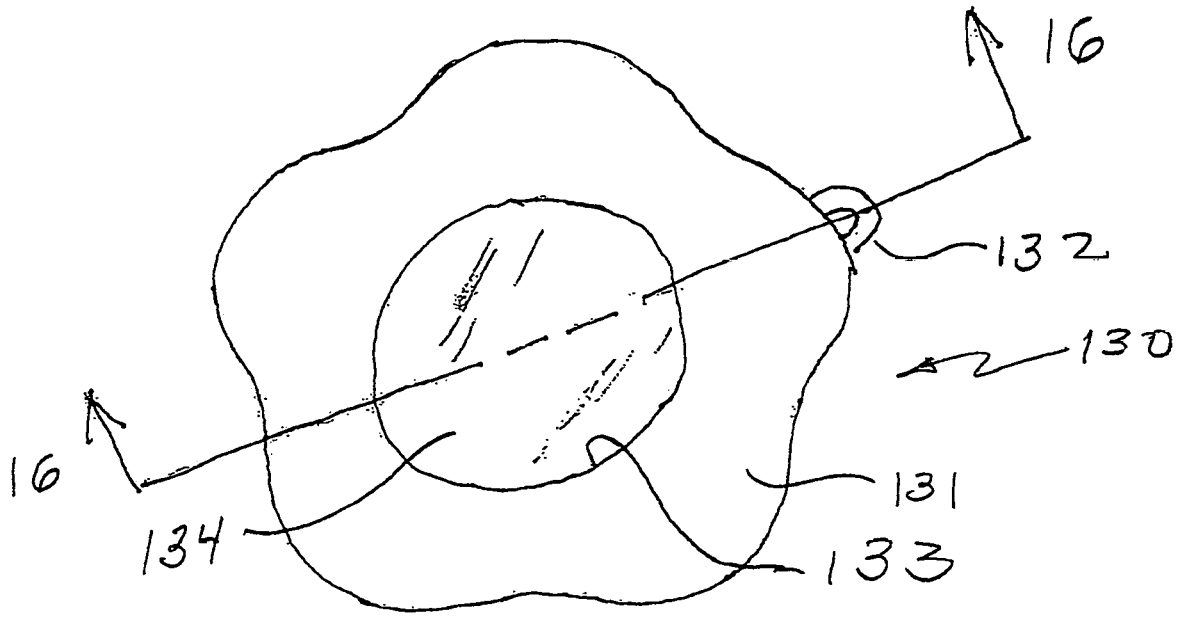
FIG. 15 sets forth a top view of an alternate embodiment the present invention tool.

FIG. 15 sets forth a top view of a tool for removal and closure of bottle and container caps generally referenced by numeral 130. Tool 130 is substantially identical to tool 10 set forth above in FIG. 2 with the difference being found in a center passage 133 extending through the entire body of tool 130. Center passage 133 may fabricated to be fully open or, alternatively, partially open Thus, tool 130 includes a resilient soft deformable body 131 which in the example of FIG. 15 is formed to replicate a flower-like structure. Tool 130 further includes a keychain attachment tab 132. A conventional bottle or container cap 134 is shown positioned within passage 133 in a typical application of tool 130. The operation of tool 130 is substantially identical to tool 10 set forth and described above.

Figure 16:
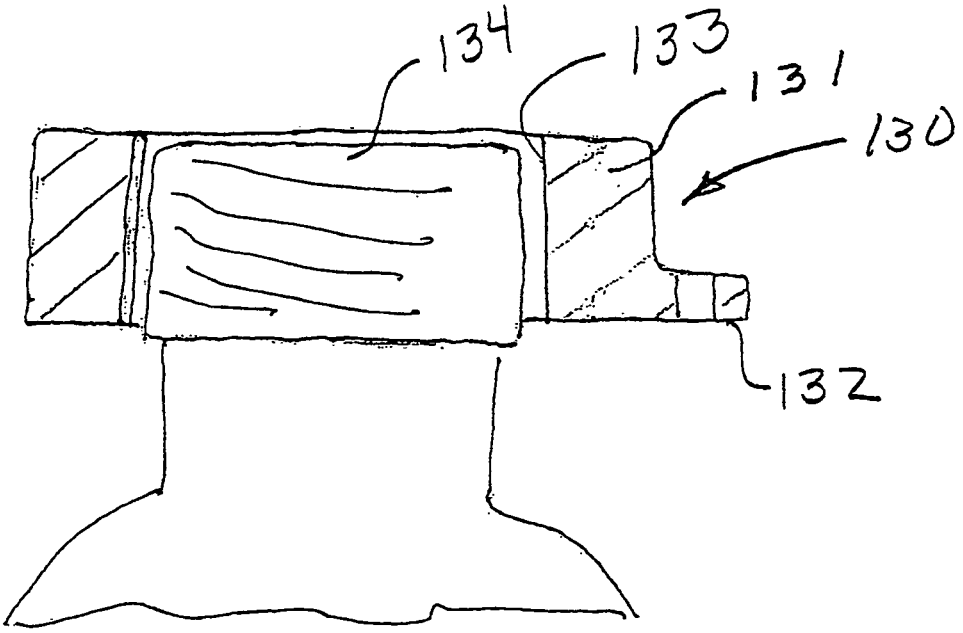
FIG. 16 sets forth a section view an alternate embodiment of the present invention tool taken along section lines 16-16 in FIG. 15 illustrating the application of the present invention tool to an illustrative bottle cap.

FIG. 16 sets forth a section view of the embodiment set forth in FIG. 15 taken along section lines 16-16 thereof. As described above, tool 130 includes a soft resilient deformable body 131 defining a center passage 133. As is also described above, tool 130 includes a keychain tab 132 used for the above-described attachment of the tool to a convenient keychain or other attachment apparatus. Thus, as is seen in FIG. 16, tool 130 having a center passage 133 is positioned upon cap 134 of a conventional bottle or container. The operation of tool 130 is, as mentioned, substantially identical to the operation of tool 10 set forth above.

Figure 17:
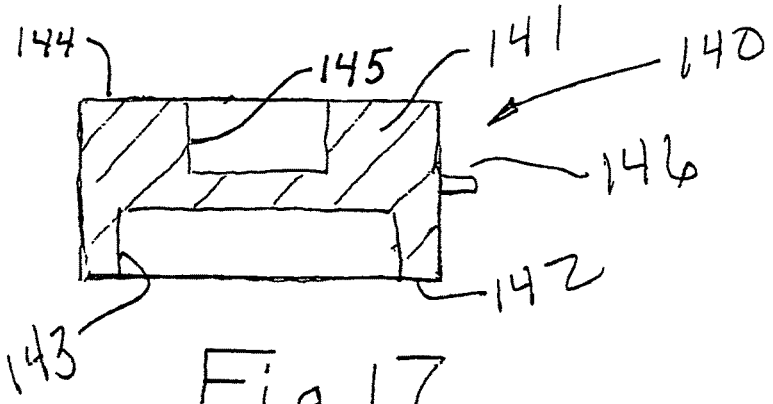
FIG. 17 sets forth a section view of a still further alternate embodiment of the present invention tool for removal and closure of bottle and container caps.

FIG. 17 sets forth a section view of a still further alternate embodiment of the present invention tool for removal and closure of bottle and container caps generally referenced by numeral 140. Tool 140 is fabricated of a soft resilient deformable body 141 supporting a keychain attachment tab 146. Body 141 further defines a bottom surface 142 and an inwardly extending cap recess 143. In addition, body 141 defines a top surface 144 and an inwardly extending cap recess 145. Recesses 143 and 145 are sized to facilitate the use of tool 140 upon significantly different sized bottle or container caps. The operation of tool 140 is substantially identical to the above-described operation of tool 10.

Figure 18:
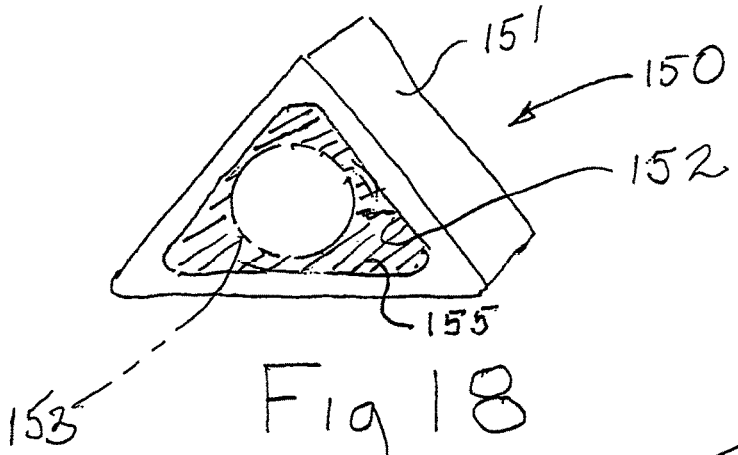
FIG. 18 sets forth a perspective view of a still further alternate embodiment of the present invention tool for removal and closure of bottle and container caps.

FIG. 18 sets forth a still further alternate embodiment of the present invention tool for removal and closure of bottle and container caps generally referenced by numeral 150. Tool 150 includes a soft resilient deformable body 151 which is configured to provide a triangular prism shape and which defines a corresponding interior passage 152 which also conforms to the triangular shape of body 151. A typical bottle or container cap 153 is shown in phantom-line depiction within the interior of triangular surface 152 having a plurality of gripping ribs 155 formed thereon. The function and operation of tool 150 is substantially identical to the above-described operation of tool 10 shown in FIG. 1. Body 151, which expands to accommodate larger bottle caps and to increase the grip upon the bottle cap, is gripped and squeezed upon cap 153 and is able to deform and engage cap 153 allowing the use of tool 150 for removal, or closure of cap 153.

Figure 19:
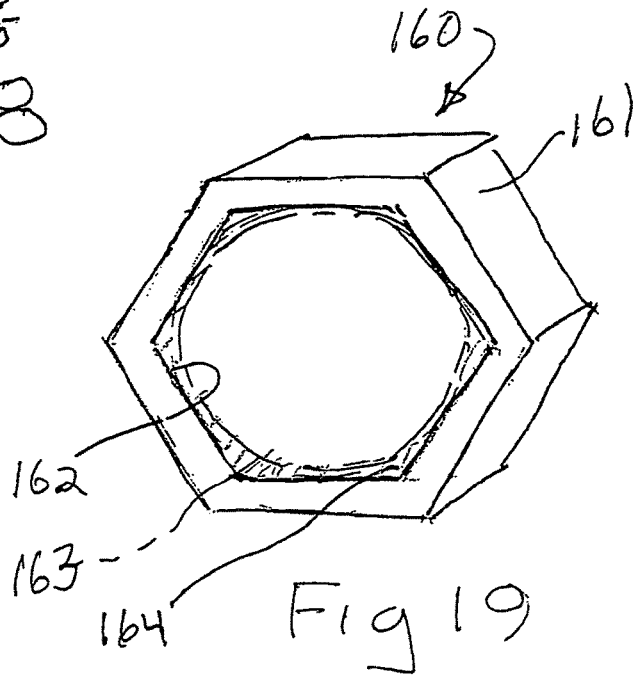
FIG. 19 sets forth a perspective view of a still further alternate embodiment of the present invention tool for removal and closure of bottle and container caps.

FIG. 19 sets forth a still further alternate embodiment of the present invention tool for removal and closure of bottle and container caps generally referenced by numeral 160. Tool 160 includes a soft resilient deformable body 161 formed in a hexagonal prism shape and defining a corresponding interior hexagonal surface 162 which supports gripping ribs 164. For purposes of illustration, a bottle or container cap 163 is shown positioned within body 161. Body 161 is squeezed and deformed against cap 163 to allow opening and closing of cap 163.

Figure 20:
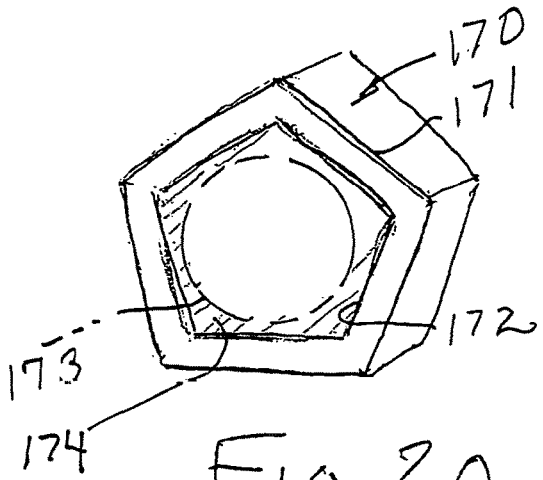
FIG. 20 sets forth a perspective view of a still further alternate embodiment of the present invention tool for removal and closure of bottle and container caps.

FIG. 20 sets forth a still further alternate embodiment of the present invention tool for removal and closure of bottle and container caps generally referenced by numeral 170. Tool 170 includes a soft resilient deformable body 171 formed to define a pentagon-shaped prism and defining a corresponding interior pentagon-shaped surface 172 which supports gripping ribs. For purpose of illustration, a typical bottle or container cap 173 is shown in phantom-line depiction within body 171.

Figure 21:
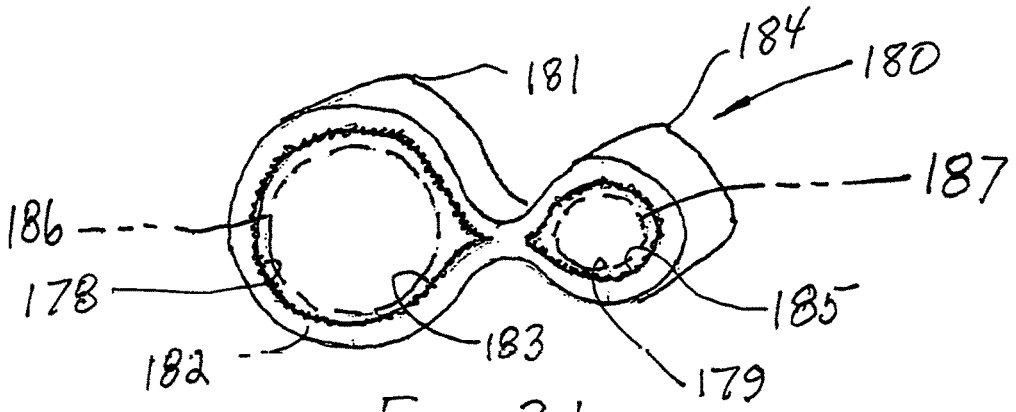
FIG. 21 sets forth a perspective view of a still further alternate embodiment of the present invention tool for removal and closure of bottle and container caps.

FIG. 21 sets forth a perspective view of a still further alternate embodiment of the tool for removal and closure of bottle and container caps generally referenced by numeral 180. Tool 180 includes a flexible resilient deformable band 181 configured to define a larger loop 182 and a smaller loop 184. An interior surface 183 of loop 182 is placed upon a larger size cap 186 such that band 181 may be squeezed upon cap 186 to twist it. Similarly, an interior surface 185 of loop 184 is placed upon a smaller size cap 187 such that band 181 may be squeezed upon cap 187 to twist it. Interior surfaces 183 and 185 each support respective pluralities of gripping ribs 178 and 179.

Figure 22:
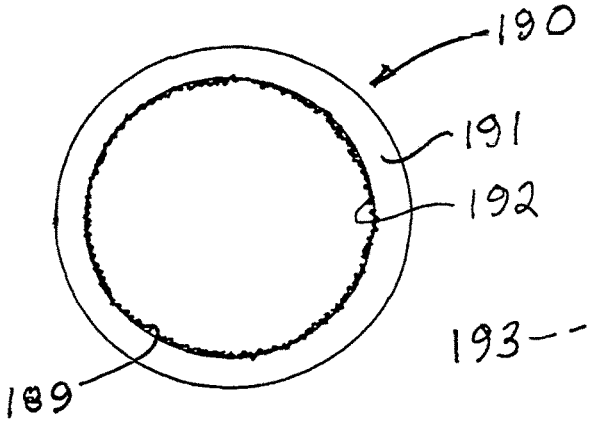
FIG. 22 sets forth a still further alternate embodiment of the present invention tool for removal and closure of bottle and container caps.

FIG. 22 sets forth a side view of a still further alternate embodiment of the tool for removal and closure of bottle and container caps generally referenced by numeral 190. Tool 190 includes a wrist band 191 having an interior gripping surface 192 therein which defines gripping ribs 189.

Figure 23:
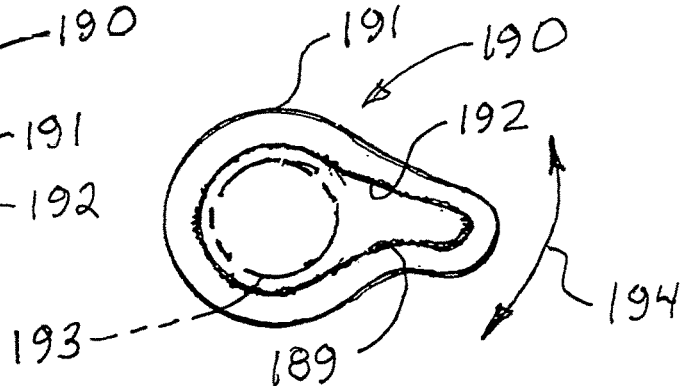
FIG. 23 sets forth an operational view of the alternate embodiment of the present invention tool for removal and closure of bottle and container caps shown in FIG. 22.

FIG. 23 sets forth an operational view of tool 190 upon a typical cap 193. Tool 190 may be worn upon the user's wrist and, when needed, may be placed upon a cap in the manner shown to engage the cap. Once engaged, tool 190 is folded upon cap 193 and squeezed into a fold which can be twisted as shown.

Figure 24:
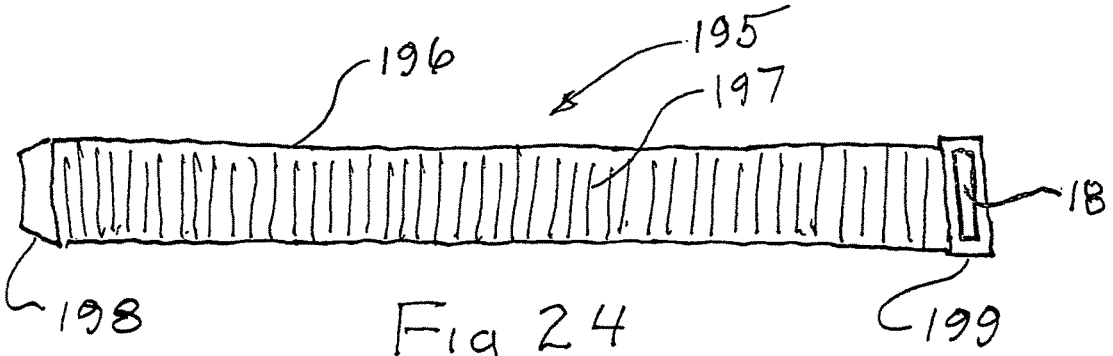
FIG. 24 sets forth a still further alternate embodiment of the present invention tool for removal and closure of bottle and container caps.

FIG. 24 sets forth a side view of a still further alternate embodiment of the tool for removal and closure of bottle and container caps generally referenced by numeral 195. Tool 195 defines a flexible soft deformable band 196 having end clasps that may be interlocked to form a wrist band similar to tool 190 shown in FIG. 22. In addition to functioning in a similar manner to tool 190 when clasps 198 and 199 are joined and retained by the insertion of clasp 198 into slot 188 of clasp 199, band 196 may be used with clasps 198 and 199 separated by simply wrapping band 196 around the cap.

Figure 25:
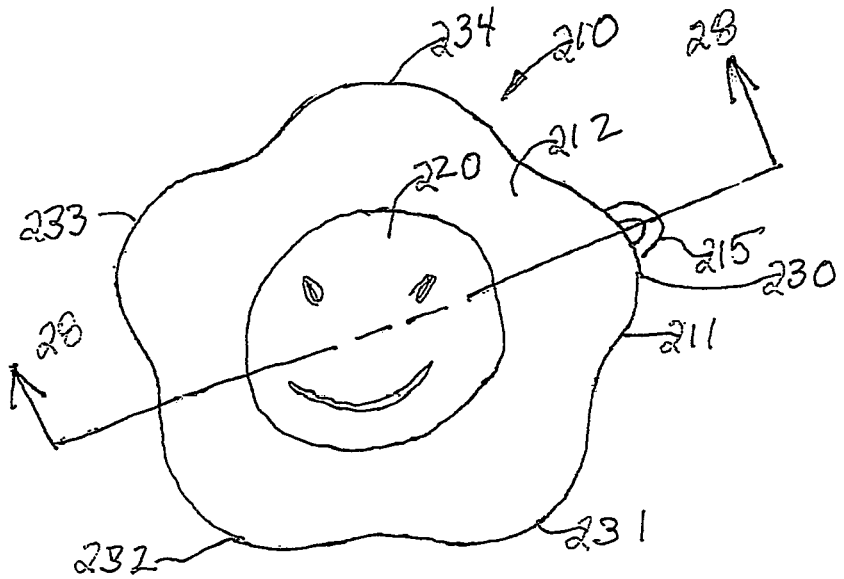
FIG. 25 sets forth a top view of a still further alternate embodiment of the present invention tool shown.

FIG. 25 sets forth a top view of a still further embodiment of the present invention tool for removal and closure of a bottle or container generally referenced by numeral 210. By way of overview, tool 210 is similar to tool 10 shown above in FIGS. 1 through 5 with the primary difference being found in the use of a body 11 formed of an inner portion 219 within body 211 which is comprised of a resilient material having a hardness substantially harder than the hardness of the remainder of body 211. Body 211 includes top 212 which in turn supports amusement icon 220. Body 211 is also shown having a plurality of circular shaped radially extending equally spaced petals 230 through 234. A key chain tab 215 extends nom body 211 at petal 230.

Figure 26:
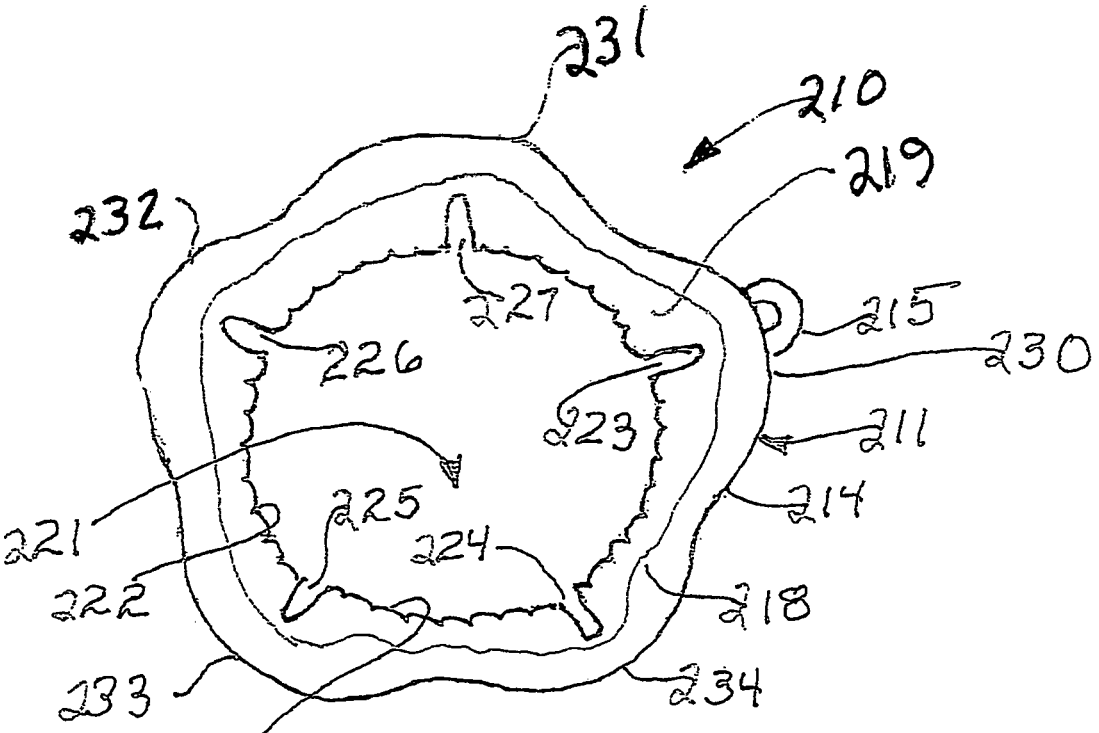
FIG. 26 sets forth a bottom view of the present invention tool shown in FIG. 25.

FIG. 26 sets forth a bottom view of tool 210. As mentioned above and as is better seen in FIG. 28, tool body 211 is formed of an outer body and an inner portion 219. Inner portion 219 defines a bottle cap recess 221. Sidewall 213 terminates in a bottom edge 214. Body 211 further includes a bottom surface 218 which encircles bottle cap recess 221. Bottle cap recess 221 is generally cylindrical in shape having a recess wall 222. Recess wall 222 defines a plurality of radially extending expansion slots 223 through 226. To maintain the maximum wall strength for recess wall 222, it is preferable that expansion slots 223 through 226 be generally centered in alignment with petals 230 through 234 as shown in FIG. 26. Additionally, in its preferred embodiment, recess wall 222 defines some type of gripping elements to better engage a bottle cap. In the example shown in FIG. 26, a plurality of parallel equally sized gripping ridges 227 are shown formed in recess wall 222.

Figure 27:
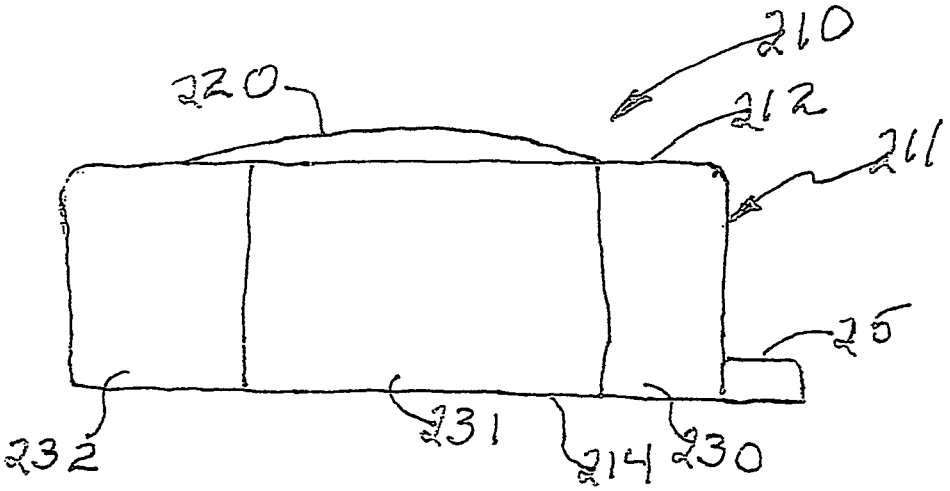
FIG. 27 sets forth a right side view of the present invention tool shown in FIG. 25, the left side view thereof being a mirror image of the right side view.

FIG. 27 sets forth a side elevation view of tool 210. It will be apparent to those skilled in the art that the left side view of tool 210 (not shown) is simply a mirror image of the right side view shown in FIG. 27. More specifically, tool 210 includes a body 211 which, as described above, is preferably formed of a resilient soft deformable material such as silicone, foam rubber or plastic within which an inner portion 219 (seen in FIG. 26) is molded using a different resilient soft deformable material such as silicone, foam rubber or plastic which has a lesser hardness than the material used in the remainder of body 211. Body 211 further defines a sidewall 213 extending downwardly from a top 212. Top 212 further supports an amusement icon 220. As is also described above, sidewall 213 is formed into a plurality of petals including petals 230, 231 and 232 seen in FIG. 27. Sidewall 213 also defines a bottom edge 214 and an outwardly extending key chain tab 215.

Figure 28:
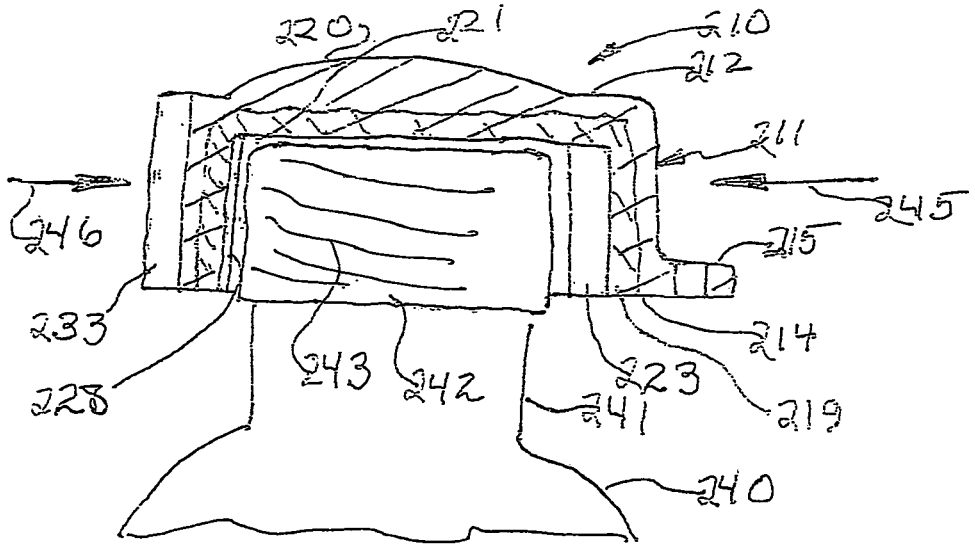
FIG. 28 sets forth a section view of the present invention tool taken along section lines 28-28 in FIG. 25 illustrating the application of the present invention tool to an illustrative bottle cap.

FIG. 28 sets forth a section view of tool 210 taken along section lines 28-28 in FIG. 25. FIG. 28 also shows an illustrative bottle neck and bottle cap received within tool 210 for purposes of illustrating the operation and use of the present invention tool. Of particular importance in FIG. 28 is the presence of inner portion 219 within body 211. The lesser hardness of inner portion 219 improves the engagement of tool 210 against bottle cap 243 while the greater hardness of the remainder of body 211 is easier to grip in the user's hand in use. In the preferred embodiment of tool 210, material having a hardness in the range of 0 Shore A to 15 Shore A is utilized for inner portion 219 and a hardness within the range of 20 Shore A to 60 Shore A is utilized for the remainder of body 211. An optimum hardness combination is provided by 10 Shore A for inner portion 219 and 45 Shore A for the remainder of body 211.

More specifically and as is described above, tool 210 includes a body 211 having a top 212 supporting an amusement icon 220. Body 211 further defines a downwardly extending surrounding sidewall 213 fabricated to provide a plurality of petals such as petals 230 and 232 seen in FIG. 28. Sidewall 213 terminates in a lower edge 214 and a bottom surface 218. Bottom surface 218 encircles a generally cylindrical bottle cap recess 221. Recess 221 formed within inner portion 219 is described above and includes a plurality of expansion slots such as slot 223 together with a plurality of gripping ridges such as ridges 227.

For purposes of illustration, a conventional bottle 240 having an upwardly extending generally cylindrical neck 241 is also shown in FIG. 28. In accordance with conventional bottling techniques, neck 241 of bottle 240 is closed and sealed by a bottle cap 242. In accordance with conventional bottling techniques, bottle neck 241 and cap 242 define cooperating threads 243 which provide the twist sealing and twist opening action of bottle 240. In accordance with the present invention, tool 210 is shown positioned upon bottle cap 242 by inserting bottle cap 242 upwardly into bottle cap recess 221. It will be apparent to those skilled in the art that in the anticipated use of the present invention tool, a range of bottle cap sizes may be accommodated by the present invention tool. Thus, in the illustration shown in FIG. 28, bottle cap 242 fits generally within the relaxed size of recess 221 within body 11. It will be apparent to those skilled in the art however that the present invention tool may accommodate a somewhat smaller bottle cap by simply being squeezed upon the bottle cap or, conversely, may accommodate a somewhat larger bottle cap 242 as the resilient material or body 211 and the cooperation of expansion slots formed therein allow tool 210 to be "stretched upon" bottle cap 242. In any event once tool 210 is situation upon bottle cap 242, the user simply grasps tool 210 and squeezes inwardly as indicated by arrows 245 and 246. The inward forces upon body 211 deform body 211 to cap 242 and create sufficient grip (friction) to allow torque applied to body 211 to be effectively transmitted to cap 242 which in turn twists cap 242 from neck 241. Once again it will be noted that forming body 211 provides that the lesser hardness of inner portion 219 improves the engagement of tool 210 against bottle cap 243 while the harder material of the remainder of body 211 is easier to grip and is more gentile against the user's hand in use.

Figure 29:
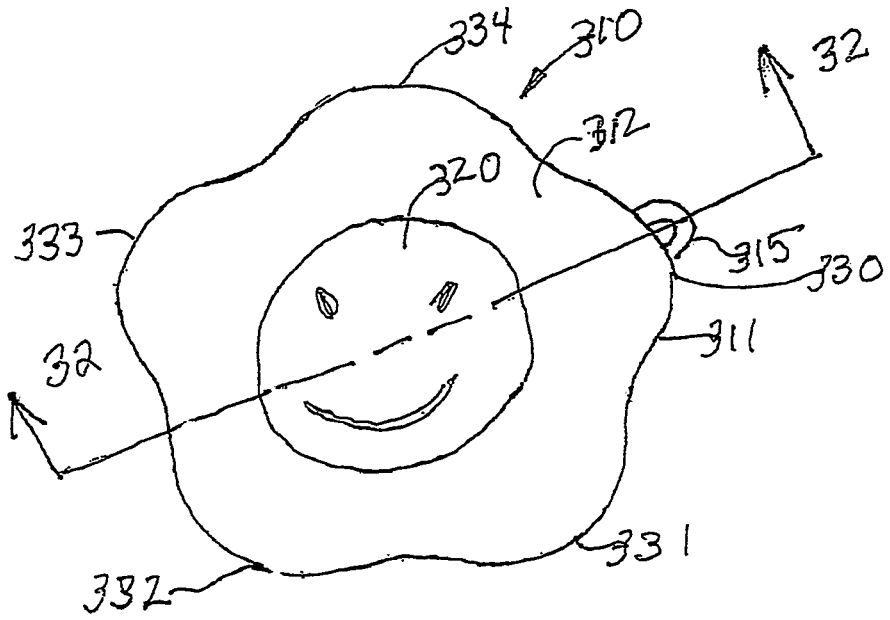
FIG. 29 sets forth a top view of a still further alternate embodiment of the present invention tool shown.

FIG. 29 sets forth a top view of a still further embodiment of the present invention tool for removal and closure of a bottle or container generally referenced by numeral 310. By way of overview, tool 310 is similar to tool 10 shown above in FIGS. 1 through 5 with the primary difference being found in the use of a body 311 an insert portion 319. Insert 319 is better seen in FIGS. 30 and 32 and is preferably formed of a molded plastic material, or the like, having a hardness in the range of 40 Shore D to 90 Shore D. Body 311 includes top 312 which in turn supports amusement icon 320. Body 311 is also shown having a plurality of circular shaped radially extending equally spaced petals 330 through 334. A key chain tab 315 extends from body 311 at petal 330.

Figure 30:
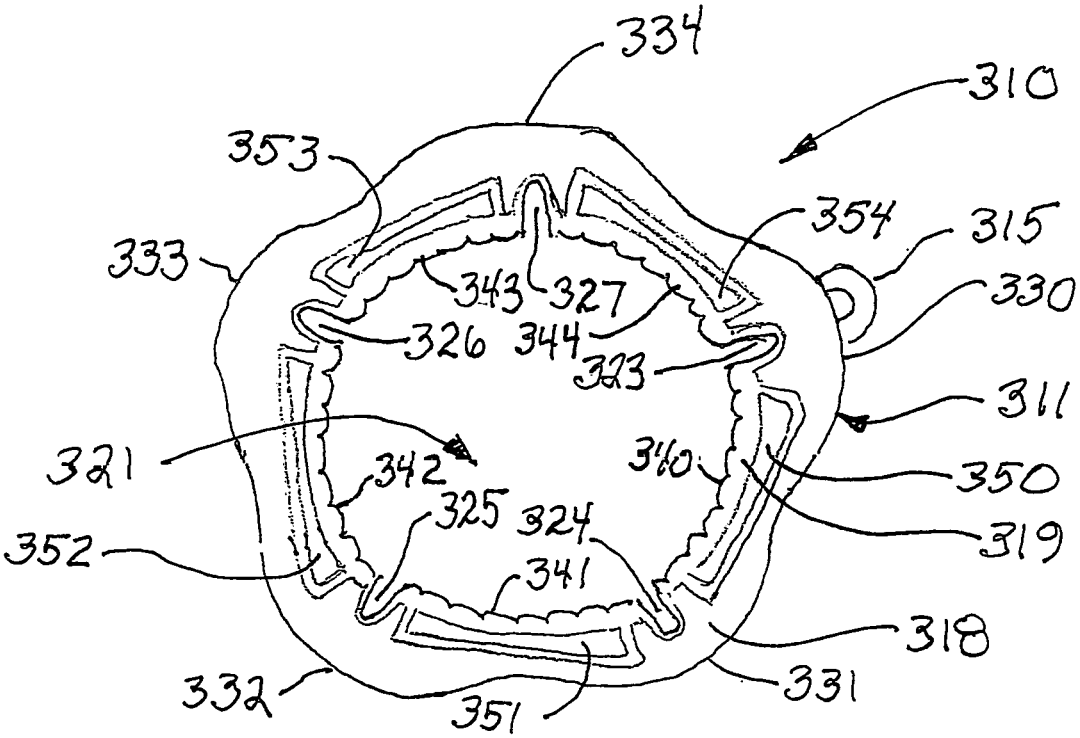
FIG. 30 sets forth a bottom view of the present invention tool shown in FIG. 29.

FIG. 30 sets forth a bottom view of tool 310. As mentioned above and as is better seen in FIG. 32, tool 310 is formed of an outer body 311 and an insert 319. Insert 319 encircles a bottle cap recess 321 formed in body 311. Body 311 further includes a bottom surface 318 which further surrounds bottle cap recess 321. Bottle cap recess 321 is generally cylindrical in shape and receives insert 319. Insert 319 defines a generally cylindrical structure formed of a plurality of cylindrically shaped gripping segments 340 through 344. Gripping segment 340 is joined to adjacent gripping segment 341 by a flexible expansion hinge 324. Gripping segment 341 is joined to adjacent gripping segment 342 by a flexible expansion hinge 325. Similarly, gripping segment 342 is joined to adjacent gripping segment 343 by a flexible expansion hinge 326 and gripping segment 343 is joined to adjacent gripping segment 344 by a flexible expansion hinge 327. Finally, the structure of insert 319 is completed by gripping segment 344 being joined to adjacent gripping segment 340 by a flexible expansion hinge 323. Gripping segments 340 through 344 define respective spaces 350 through 354 on their outer surfaces. Insert 319 is molded into body 311 during the molding process in which insert 319 is fixed within body 311. The attachment of insert 319 is further secured by the flow of body material into spaces 350 through 354.

Figure 31:
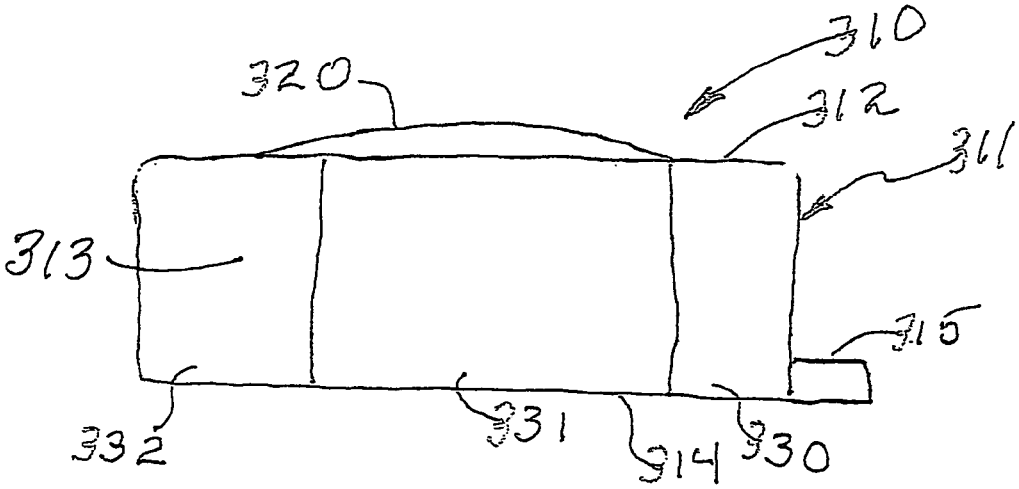
FIG. 31 sets forth a right side view of the present invention tool shown in FIG. 29, the left side view thereof being a mirror image of the right side view.

FIG. 31 sets forth a right side elevation view of tool 310. It will be apparent to those skilled in the art that the left side view of tool 310 (not shown) is simply a mirror image of the right side view shown in FIG. 31. More specifically, tool 310 includes a body 311 which, as described above, is preferably formed of a resilient soft deformable material such as silicone foam, rubber or plastic within which an insert 319 is molded. Body 311 further defines a sidewall 313 extending downwardly from a top 312. Top 312 further supports an amusement icon 320. As is also described above, sidewall 313 is formed into a plurality of petals including petals 330, 331 and 332 seen in FIG. 31. Sidewall 313 also defines a bottom edge 314 and an outwardly extending keychain tab 315.

Figure 32:
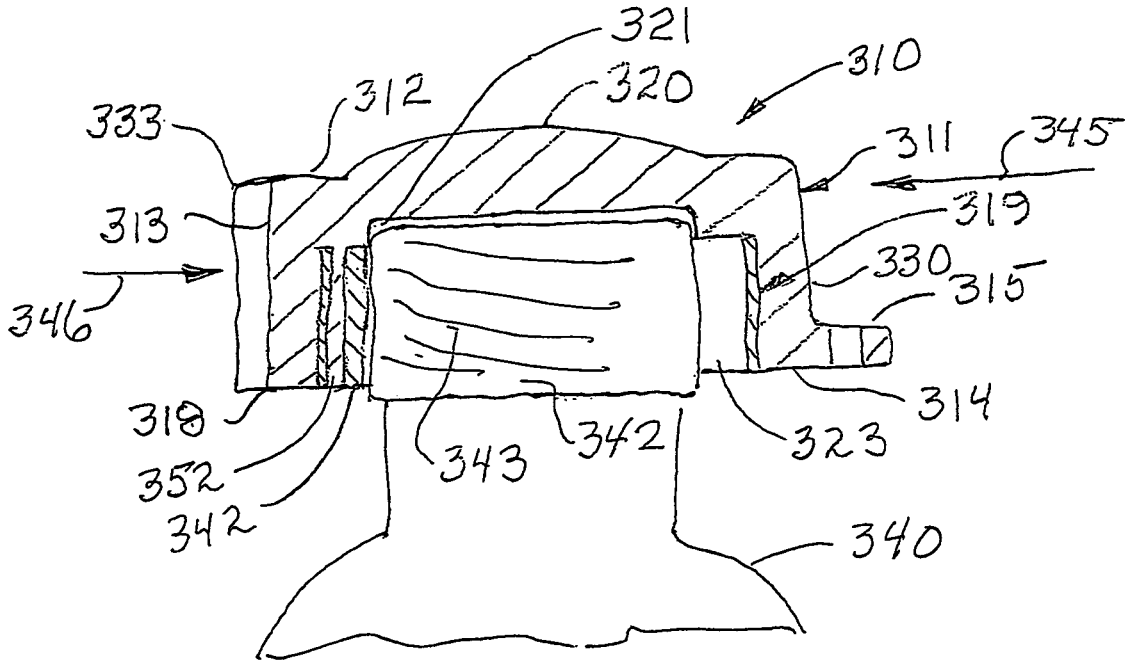
FIG. 32 sets forth a section view of the present invention tool taken along section lines 32-32 in FIG. 29 illustrating the application of the present invention tool to an illustrative bottle cap.

FIG. 32 sets forth a section view of tool 310 taken along section lines 32-32 in FIG. 29. FIG. 32 also shows an illustrative bottle neck and bottle cap received within tool 310 for purposes of illustrating the operation and use of the present invention tool. Of particular importance in FIG. 32 is the presence of insert 319 within body 311. The greater hardness of insert 319 improves the engagement of tool 310 against bottle cap 343 while the softer hardness of the remainder of body 311 is easier to grip and is more gentile against the user's hand in use. In the preferred embodiment of tool 310, a hardness in the range of 40 Shore D to 90 Shore D is utilized for insert 319 and a hardness within the range of 30 Shore A to 70 Shore A is utilized, for the remainder of body 311. An optimum hardness combination is provided by 70 Shore D for insert 319 and 45 Shore A for the remainder of body 311.

More specifically and as is described above, tool 310 includes a body 311 having a top 312 supporting an amusement icon 320. Body 311 further defines a downwardly extending surrounding sidewall 313 fabricated to provide a plurality of petals such as petals 330 and 333. Sidewall 313 terminates in a lower edge 314 and a bottom surface 318.

For purposes of illustration, a conventional bottle 340 having an upwardly extending generally cylindrical neck 341 is also shown in FIG. 32. In accordance with conventional bottling techniques, neck 341 of bottle 340 is closed and sealed by a bottle cap 342. In accordance with conventional bottling techniques, bottle neck 341 and cap 342 define cooperating threads 343 which provide the twist sealing and twist opening action of bottle 340. In accordance with the present invention, tool 310 is shown positioned upon bottle cap 342 by inserting bottle cap 342 upwardly into bottle cap recess 321. During the insertion of cap 342 into cap recess 321, the size of cap 342 is accommodated by expansion hinges 323 through 327 (seen in FIG. 30). To accommodate cap 342 expansion hinges 323 through 327 flex increasing the space between gripping segments 340 through 344 (also better seen in FIG. 30). Once tool 310 is situated upon bottle cap 342, the user simply grasps tool 310 and squeezes inwardly as indicated by arrows 345 and 346. The inward forces upon body 311 deforms body 311 and presses gripping segments against cap 342 creating sufficient grip (friction) to allow torque applied to body 311 to be effectively transmitted to cap 342 which in turn twists cap 342 from neck 341. As the torque is applied to body 311, the portions of molded material of body 311 which extend into spaces 350 through 354 bind insert 319 to body 311 and sustain the torque. Once again it will be noted that forming body 311 having insert 319 molded therein provides that the greater hardness of insert 319 to improve the engagement of tool 310 against bottle cap 343 while the softer material of the remainder of body 311 is easier to grip and is more gentile against the user's hand in use It will be apparent to those skilled in the art from the descriptions and figures set forth above that the various shapes for the tool body set forth are merely illustrative and should not be considered limiting in the shape and configuration which the present invention tool may assume. Thus, it will be apparent that virtually any shape may be selected for the present invention tool without departing from the spirit and scope of the present invention.

The tool shown is easily fabricated of a soft deformable resilient material such as silicone foam rubber or foam plastic, silicone rubber, PVC or other elastomers and greatly improves, and facilitates the removal of twist-type bottle caps with particular advantage to users which have some difficulty in manipulating such bottle caps.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A tool for removal and closure of bottle and container caps, said tool comprising:

a tool body having a top wall and a tool body sidewall extending from said top wall, said top wall and said tool body sidewall being formed of a resilient stretchable material;

the tool body sidewall having a thickness between a tool body sidewall exterior surface and a tool body sidewall interior surface, which defines a cap recess having a centerline extending parallel to a height of said tool body; and a plurality of gripping elements formed on said tool body sidewall interior surface, each of said gripping elements projecting from said tool body sidewall interior surface towards said centerline recess wall;

said tool body sidewall interior surface further comprising a plurality of expansion slots, including a first expansion slot and a second expansion slot; each of said plurality of expansion slots extending radially from said tool body sidewall interior surface into said thickness between said tool body sidewall exterior surface and said tool body sidewall interior surface, away from said centerline, and into but not entirely through said tool body sidewall, said plurality of expansion slots being bridged by remaining unslotted portions of said tool body sidewall and said tool body sidewall allowing the plurality of expansion slots to stretch and expand to receive bottle and container caps, one at a time, in said cap recess;

said tool being locatable over a bottle or container cap by forcing said cap recess upon the bottle or container cap such that said plurality of gripping elements engage the bottle or container cap and said plurality of expansion slots allowing said tool body sidewall to expand and be stretched upon the bottle or container cap thereby creating a squeezing force upon the bottle or container cap and accommodating said bottle or container cap while said remaining unslotted portions of said tool body sidewall maintaining said squeezing force; and wherein said tool body sidewall exterior surface defines a sidewall perimeter that is stretchable from a first cross-sectional dimension at two opposed exterior locations to a second cross-sectional dimension at the two opposed exterior locations.

2. The tool set forth in claim 1 wherein said plurality of gripping elements include a plurality of ridges extending upwardly from said bottom surface upon said tool body sidewall interior surface.

3. The tool set forth in claim 2 wherein said tool body includes an inner portion and a remainder portion of said tool body, said inner portion formed of a first resilient material having a first hardness and said remainder portion being formed of a second resilient material having a second hardness.

4. The tool set forth in claim 3 wherein said first hardness is softer than said second hardness.

5. The tool set forth in claim 4 wherein said first hardness is between 0 Shore A and 15 Shore A and wherein said second hardness is between 20 Shore A and 60 Shore A.

6. The tool set forth in claim 1 wherein said tool body sidewall exterior surface defines a matte finish and said tool body sidewall interior surface defines a shiny surface.

7. The tool set forth in claim 1 wherein said plurality of gripping elements and said plurality of expansion slots are located on portions of the tool body that are stretchable from the first cross-sectional dimension to the second cross-sectional dimension.

8. The tool set forth in claim 7 wherein said first expansion slot is located between a first pair of gripping elements and said second expansion slot is located between a second pair of gripping elements.

9. The tool set forth in claim 8 further comprising a third expansion slot located between a third pair of gripping elements.

10. The tool set forth in claim 1 wherein said top wall and said tool body sidewall define a flower-like shape, a hexagonal bolt head shape, a vehicle tire shape, or a wheel shape.

11. The tool set forth in claim 1 wherein said tool body has a top surface and a bottom surface and said cap recess includes:

a first cylindrical recess, extending from said bottom surface, having a first diameter and defining a first plurality of radially extending expansion slots; and a second cylindrical recess extending from said first cylindrical recess having a second diameter and defining a second plurality of radially extending expansion slots;

said first diameter being greater than said second diameter.

12. A tool for removal and closure of bottle and container caps, each of said bottle and container caps defining a bottle and container cap diameter, said tool comprising:

a tool body formed of a resilient material having top wall and a tool body sidewall extending from said top wall, said tool body sidewall comprising an exterior surface and an interior surface defining a sidewall thickness therebetween and said tool body having a centerline extending parallel to a height of said tool body;

a cap recess having a cap recess diameter defined by said interior surface of said tool body sidewall extending into said tool body from a bottom edge of said tool body sidewall;

a plurality of gripping elements formed in said cap recess, each of said plurality of gripping elements projecting from said interior surface of said tool body sidewall toward said centerline;

a plurality of expansion slots, including a first expansion slot and a second expansion slot; each of said plurality of expansion slots extending radially from said interior surface into said thickness towards but short of said exterior surface and away from said centerline;

said cap recess diameter being smaller than said bottle and container cap diameter, said tool being fitted upon the bottle or container cap by forcing said cap recess upon the bottle or container cap such that said plurality of gripping elements engage the bottle or container cap in a preload condition and said plurality of expansion slots allowing said tool body to be stretched upon and accommodate said bottle or container cap; and wherein said first expansion slot is located between a first pair of gripping elements and said second expansion slot is located between a second pair of gripping elements.

13. The tool set forth in claim 12 wherein said sidewall of said body defines a matte finish and said interior recess wall defines a shiny surface.

14. A tool for removal of bottle and container caps, said tool comprising:

a tool body having a top wall and a sidewall depending from the top wall, said top wall and said sidewall defining a cap recess having an interior space, said tool body being formed of a resilient stretchable material, and said sidewall having an interior surface and an exterior surface defining a thickness therebetween;

a plurality of gripping elements projecting from said interior surface of said sidewall towards a center of said cap recess;

a plurality of spaced apart expansion slots formed in said interior space in said sidewall, each of said plurality of expansion slots is formed as a recess extending from said interior surface and away from said center of said cap recess into said thickness and each having a depth that is less than said thickness of said sidewall, said plurality of expansion slots being bridged by remaining portions of said sidewall to define a sidewall perimeter that is stretchable from a first cross-sectional dimension at two opposed exterior locations to a second cross-sectional dimension at the two opposed exterior locations, wherein said second cross-sectional dimension is greater than said first cross-sectional dimension; and said tool is configured to be fitted upon a bottle or container cap by forcing said cap recess upon said bottle or container cap so that said plurality of gripping elements contact said bottle or container cap and said expansion slots allowing said sidewall to expand to said second cross-sectional dimension and be stretched upon the bottle or container cap thereby creating a squeezing force upon the bottle or container cap with said stretched sidewall.

15. The tool set forth in claim 14, wherein said plurality of spaced apart expansion slots include a first expansion slot and a second expansion slot and wherein the first expansion slot is located between a first pair of gripping elements and the second expansion slot is located between a second pair of gripping elements.

16. The tool set forth in claim 15, wherein said tool body includes an inner portion and a remainder portion of said tool body, said inner portion formed of a first resilient material having a first hardness and said remainder portion being formed of a second resilient material having a second hardness.

17. The tool set forth in claim 14, further comprising a keychain tab and a length of keychain attached to the keychain tab.

18. The tool set forth in claim 14, wherein the sidewall has a plurality of petals.

19. The tool set forth in claim 18, wherein each of said plurality of petals comprises an arcuate exterior sidewall surface and a maximum thickness.

20. The tool set forth in claim 19, wherein each one of said plurality of spaced apart expansion slots is aligned with each one of said plurality of petals.

* * * * *